US010099838B2

(12) United States Patent
Dean et al.

(10) Patent No.: US 10,099,838 B2
(45) Date of Patent: Oct. 16, 2018

(54) FLUID CARTRIDGE SYSTEM AND METHOD OF USING A FLUID CARTRIDGE SYSTEM

(71) Applicant: Nordson Corporation, Westlake, OH (US)

(72) Inventors: Crispin B. Dean, Langebrueck (DE); Robert W. Springhorn, Cream Ridge, NJ (US)

(73) Assignee: Nordson Corporation, Westlake, OH (US)

( * ) Notice: Subject to any disclaimer, the term of this patent is extended or adjusted under 35 U.S.C. 154(b) by 328 days.

(21) Appl. No.: 14/684,500

(22) Filed: Apr. 13, 2015

(65) Prior Publication Data

US 2016/0296963 A1 Oct. 13, 2016

(51) Int. Cl.
*B05C 17/01* (2006.01)
*B65D 81/32* (2006.01)
(Continued)

(52) U.S. Cl.
CPC ..... *B65D 81/325* (2013.01); *B05C 17/0106* (2013.01); *B65D 39/0052* (2013.01);
(Continued)

(58) Field of Classification Search
CPC .. B65D 81/325; B65D 39/052; B65D 39/007; B05C 17/0106; B05C 17/0123; B05C 17/00513
See application file for complete search history.

(56) References Cited

U.S. PATENT DOCUMENTS 3,323,682 A * 6/1967 Creighton, Jr. ... B05C 17/00513 222/105
3,366,265 A * 1/1968 Hesselbarth ..... B65D 21/0204 220/23.4
(Continued)

FOREIGN PATENT DOCUMENTS

DE 202006016528 U1 2/2008
EP 0521434 A1 1/1993
(Continued)

OTHER PUBLICATIONS

International Application No. PCT/US2016/024413: International Search Report and the Written Opinion dated Jul. 12, 2016, 14 pages.
(Continued)

*Primary Examiner* — Nicholas J Weiss
(74) *Attorney, Agent, or Firm* — Baker & Hostetler LLP

(57) ABSTRACT

A fluid cartridge system and method of removing a closure assembly from a first cartridge and a second cartridge includes a first cartridge body and a second cartridge body. A neck projects from the first cartridge body with a first outlet of the first cartridge and a second outlet of the second cartridge. A first closure having a first plug is received within the first outlet and includes a first closure coupling element. In addition, a second closure having a second plug is received within the second outlet and includes a second closure coupling element. The first closure coupling element is configured to interlock with the second closure coupling element such that securing the first cartridge body against the second cartridge body also connects the first closure to the second closure. As such, the first and second closures form the closure assembly for being collectively removed by an operator.

9 Claims, 32 Drawing Sheets

(51) Int. Cl.
*B65D 39/00* (2006.01)
*B05C 17/005* (2006.01)

(52) U.S. Cl.
CPC .. *B05C 17/00513* (2013.01); *B05C 17/00553* (2013.01); *B05C 17/0123* (2013.01)

(56) References Cited

U.S. PATENT DOCUMENTS 3,506,157 A * 4/1970 Dukess ..... B65D 35/22 222/563
4,754,898 A * 7/1988 Britt ..... B65D 47/0842 220/255
4,974,756 A * 12/1990 Pearson ..... B65D 81/325 222/137
5,137,182 A * 8/1992 Keller ..... B05C 17/00509 222/153.1
5,228,599 A * 7/1993 Keller ..... B05C 17/00513 222/137
5,249,709 A 10/1993 Duckworth et al.
5,423,443 A * 6/1995 Keller ..... B65D 39/16 215/211
5,462,205 A * 10/1995 Keller ..... B65D 81/325 222/145.1
6,769,564 B2 * 8/2004 Prestele ..... B65D 81/3283 215/274
7,694,853 B2 * 4/2010 Keller ..... B65D 39/16 215/332
7,841,481 B2 * 11/2010 Gleich ..... B65D 81/3288 215/6
8,074,843 B2 * 12/2011 Keller ..... B05C 17/00506 222/137
8,100,295 B2 * 1/2012 Keller ..... B05C 17/00506 222/137
8,544,683 B2 10/2013 Springhorn et al.
9,522,368 B2 * 12/2016 Bublewitz ..... A61M 5/31596
9,555,928 B2 * 1/2017 Ettlin ..... B05C 17/00553
2010/0102088 A1 * 4/2010 Keller ..... B65D 81/325 222/137
2014/0203023 A1 7/2014 Ettlin

FOREIGN PATENT DOCUMENTS

KR 200396507 Y1 9/2005
WO 2007098624 A1 9/2007
WO 2013056874 A1 4/2013

OTHER PUBLICATIONS

English Translation of International Preliminary Report on Patentability Chapter II or English Translation of International Preliminary Report on Patentability Chapter I dated Oct. 26, 2017 for WO Application No. PCT/US16/024413.

* cited by examiner

FLUID CARTRIDGE SYSTEM AND METHOD OF USING A FLUID CARTRIDGE SYSTEM

TECHNICAL FIELD

The present invention relates generally to fluid cartridge system and method of use, and more particularly, to a closure assembly for sealing outlets of the first and second cartridges.

BACKGROUND

A variety of fluid cartridge systems having multiple component mixing and dispensing devices exist, including those in which the fluid chambers are in a side-by-side configuration. Such cartridges are often placed in a handheld dispensing applicator having one or more movable drive rods engaging one or more pistons associated with the fluid chambers to dispense and mix the multiple components from an end of the cartridge. For example, a resin cartridge containing a fluid resin component and an activator cartridge containing a fluid activator component may be selected and loaded into the handheld dispensing applicator for use.

Due to the reaction that occurs between the multiple components, such as the fluid resin and fluid activator components, these components are separately contained within the resin and activator cartridges. The resin and activator cartridges may be manufactured and formed together as a pair to be sealed together with an integral and unitarily formed closure for storage. However, the fluid resin component often has a different shelf life than the fluid activator component such that when one component perishes, the other must simply be discarded out of necessity. Furthermore, permeation of the fluid activator component through the activator cartridge tends to react with the fluid resin component resulting in a shorter shelf life for the pair of products.

In order to improve shelf life and reduce waste, the resin cartridge and the fluid activator cartridge may be formed and stored separately and secured together shortly before use with the dispensing applicator. As such, any permeation of the activator component may occur apart from the resin cartridge for improved shelf life.

While separate cartridges may improve shelf life, the cartridges themselves require additional handling and greater complexity to accommodate such connection. More particularly, each of the component cartridges requires its own closure for sealing an outlet of the cartridge, effectively doubling the number of closures required for the pair of cartridges. For example, the closures must be individually removed and discarded from the resin cartridge and the activator cartridge prior to use. Moreover, if an operator inadvertently fails to remove one of the closures, the fluid cartridge system may require disassembly, cleaning, and removal of the remaining closure to correct the improper closure removal. In any case, the additional closures tend to require additional assembly resulting in reduced efficiency, particularly in a fast paced, manufacturing environment.

There is a need for a fluid cartridge system and method of removing a closure from two or more cartridges, such as a resin cartridge and an activator cartridge, for reducing assembly time and reducing the likelihood of improper closure removal that addresses present challenges and characteristics such as those discussed above.

SUMMARY

An exemplary embodiment of a fluid cartridge system for dispensing a first fluid and a second fluid respectively from a first cartridge and a second cartridge via a dispensing applicator includes a first cartridge body. The first cartridge has a first cartridge body with a first chamber for containing the first fluid. The first cartridge body is configured to secure against a second cartridge body of the second cartridge in a side-by-side configuration. A first neck portion projects from the first cartridge body and includes a first outlet communicating with the first chamber for discharging the first fluid therefrom. The first neck portion is configured to operatively connect to a second neck portion of the second cartridge to form a neck. In addition, the fluid cartridge system has a first closure including a first plug projecting therefrom. The first plug is received within the first outlet to fluidly seal the first outlet of the first cartridge. The first closure has a first closure coupling element configured to operatively connect to a second closure received within a second outlet of the second cartridge. Thereby, the first closure and the second closure form a closure assembly for being collectively removed by an operator.

In use, a method of removing a closure assembly from a first cartridge containing a first fluid and a second cartridge containing a second fluid includes securing the first cartridge against the second cartridge in the side-by-side configuration and defining the neck of the first and second cartridges. The method also includes operatively connecting the first closure portion to the second closure portion in order to define the closure assembly.

Various additional objectives, advantages, and features of the invention will be appreciated from a review of the following detailed description of the illustrative embodiments taken in conjunction with the accompanying drawings.

DETAILED DESCRIPTION

Figure 1:
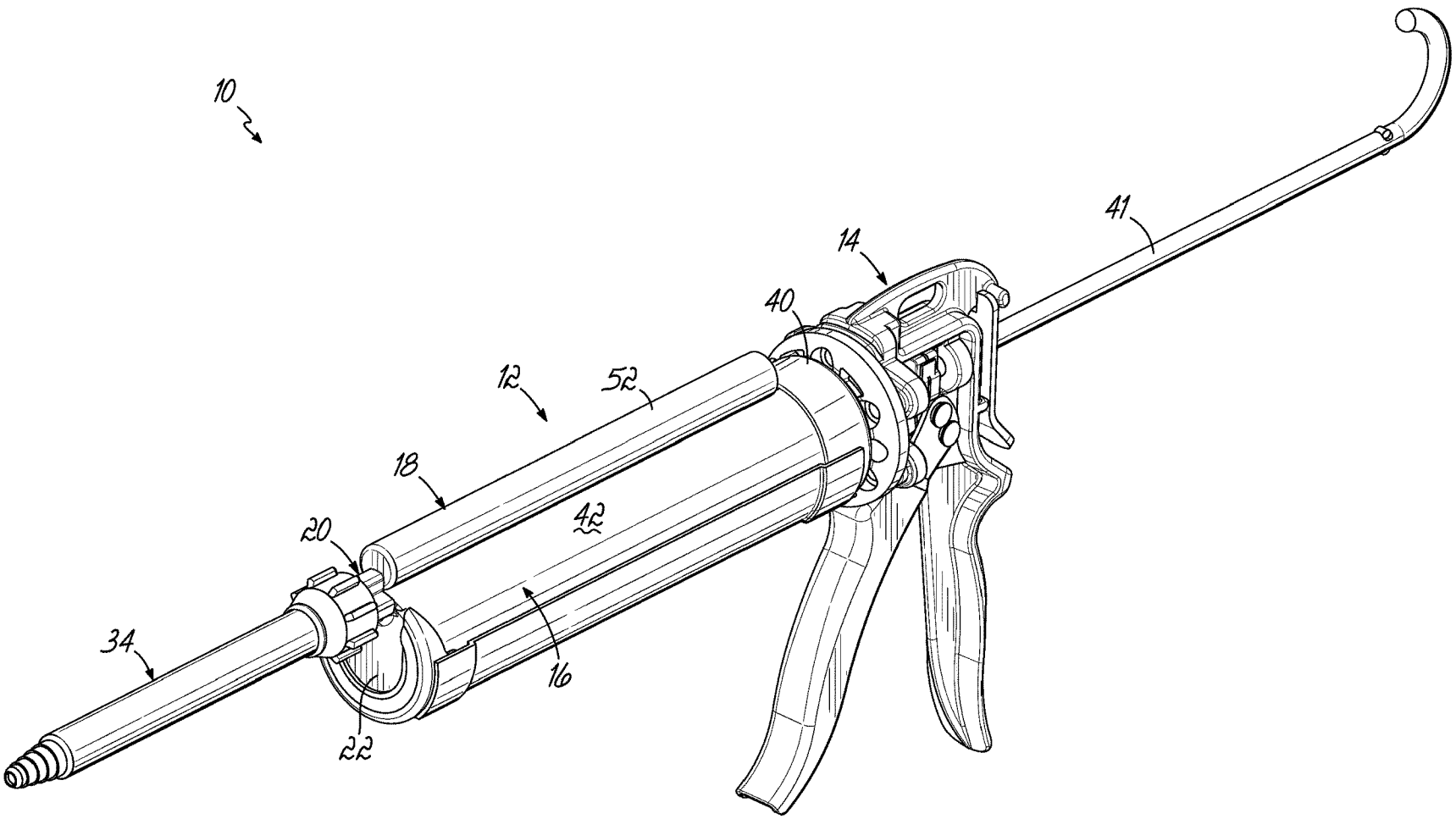
FIG. 1 is a perspective view of a first embodiment of a fluid cartridge system according to the invention described herein.
Figure 2:
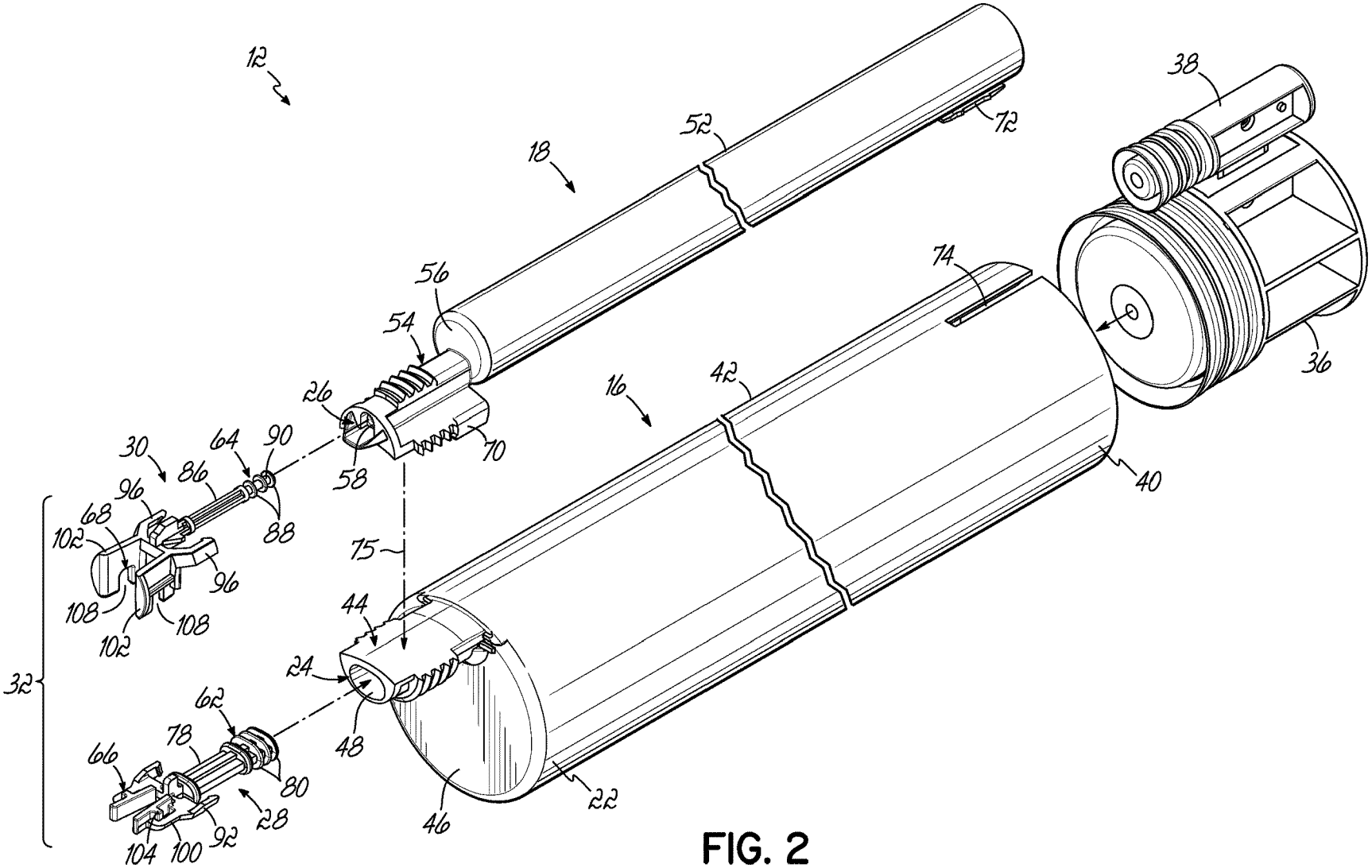
FIG. 2 is an upper exploded perspective view of a multi-component cartridge assembly shown in FIG. 1.
Figure 3A:
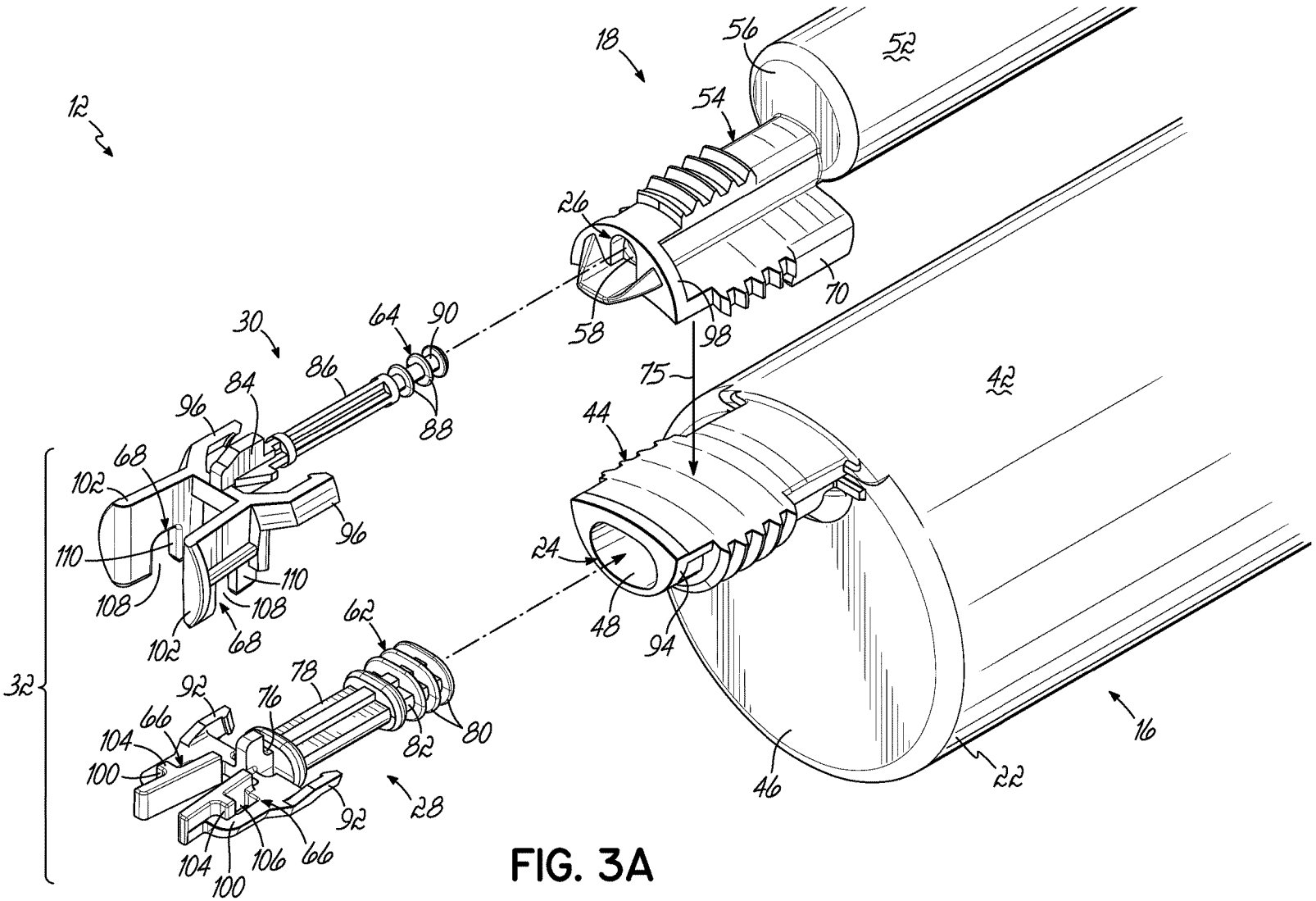
FIG. 3A is an upper enlarged exploded perspective view of the multi-component cartridge assembly shown in FIG. 1.
Figure 3B:
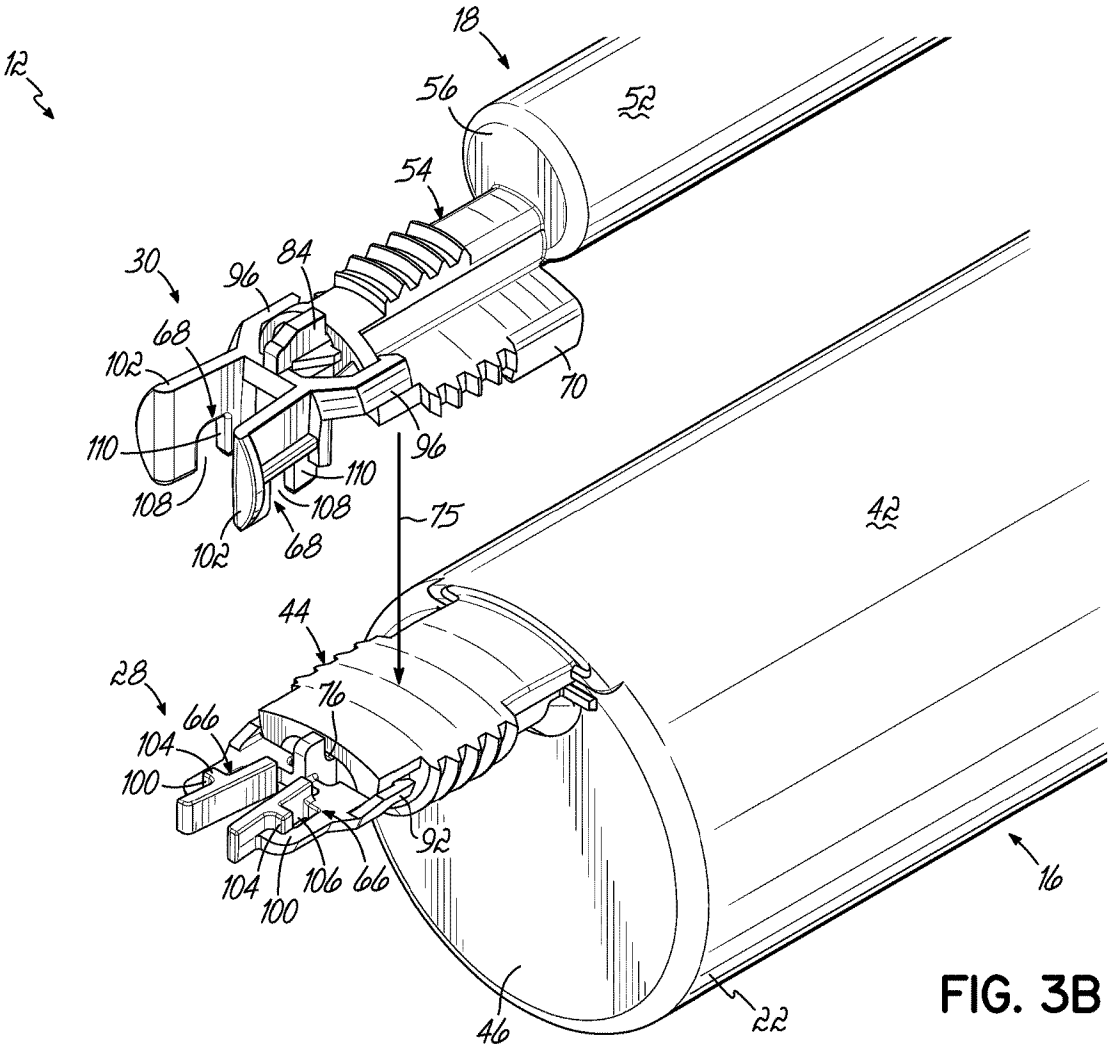
FIG. 3B is an upper perspective view similar to FIG. 3A, but showing a pair of closures respectively connected to a pair of cartridges.
Figure 3C:
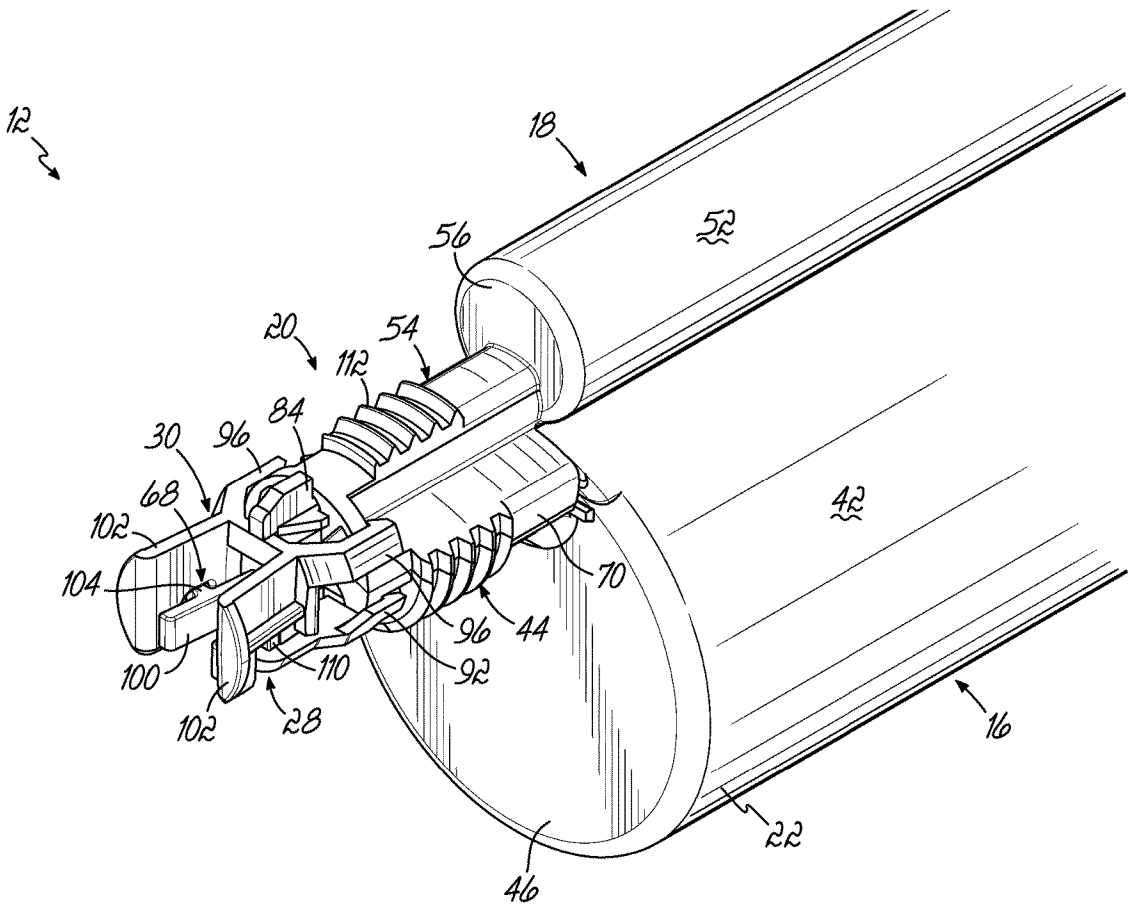
FIG. 3C is an upper perspective view similar to FIG. 3B, but showing the pair of cartridges secured to each other and the pair of closures interlocked to define a closure assembly.
Figure 3D:
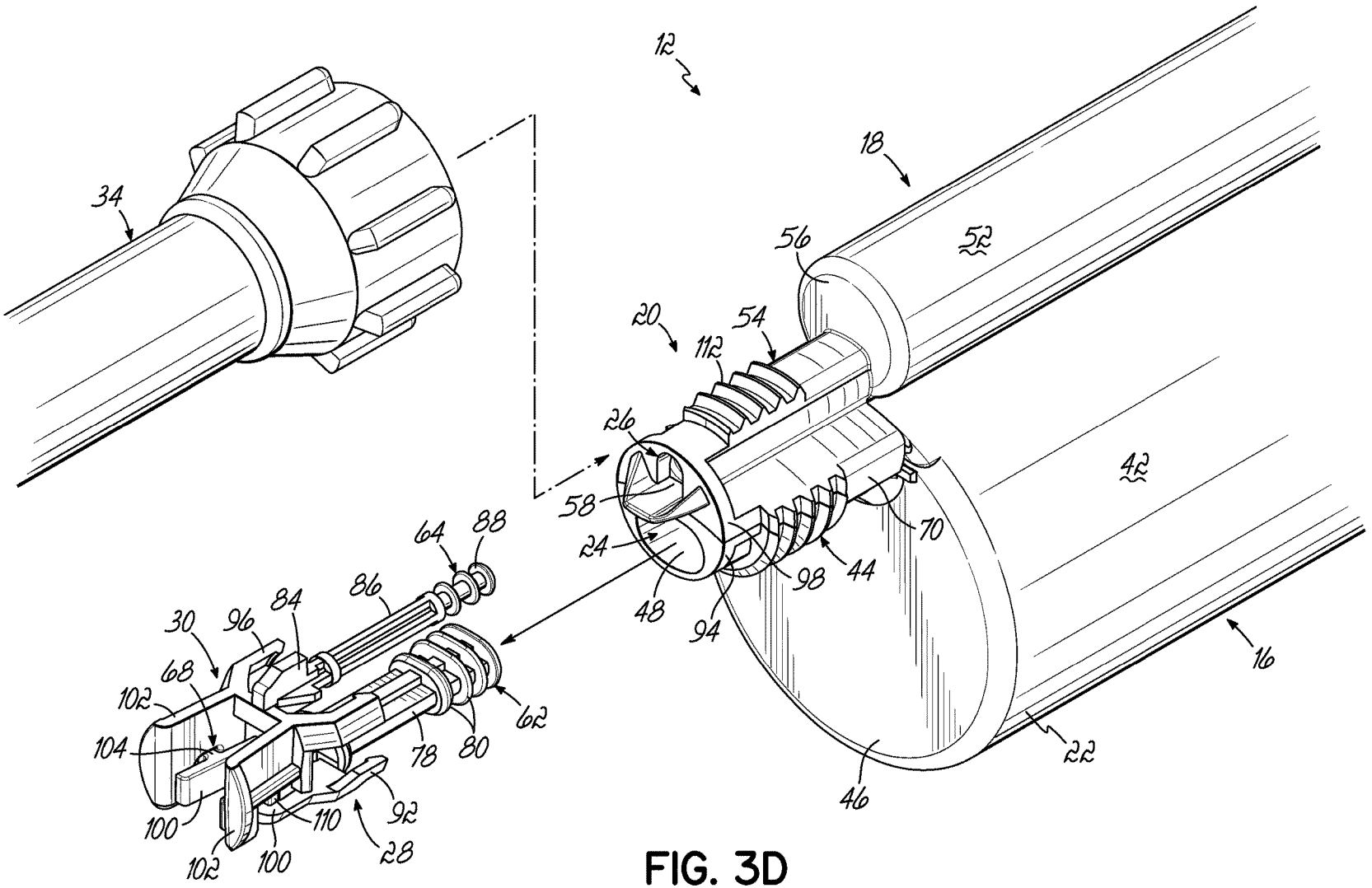
FIG. 3D is an upper perspective view similar to FIG. 3C, but showing the closure assembly removed from the pair of cartridges.
Figure 4A:
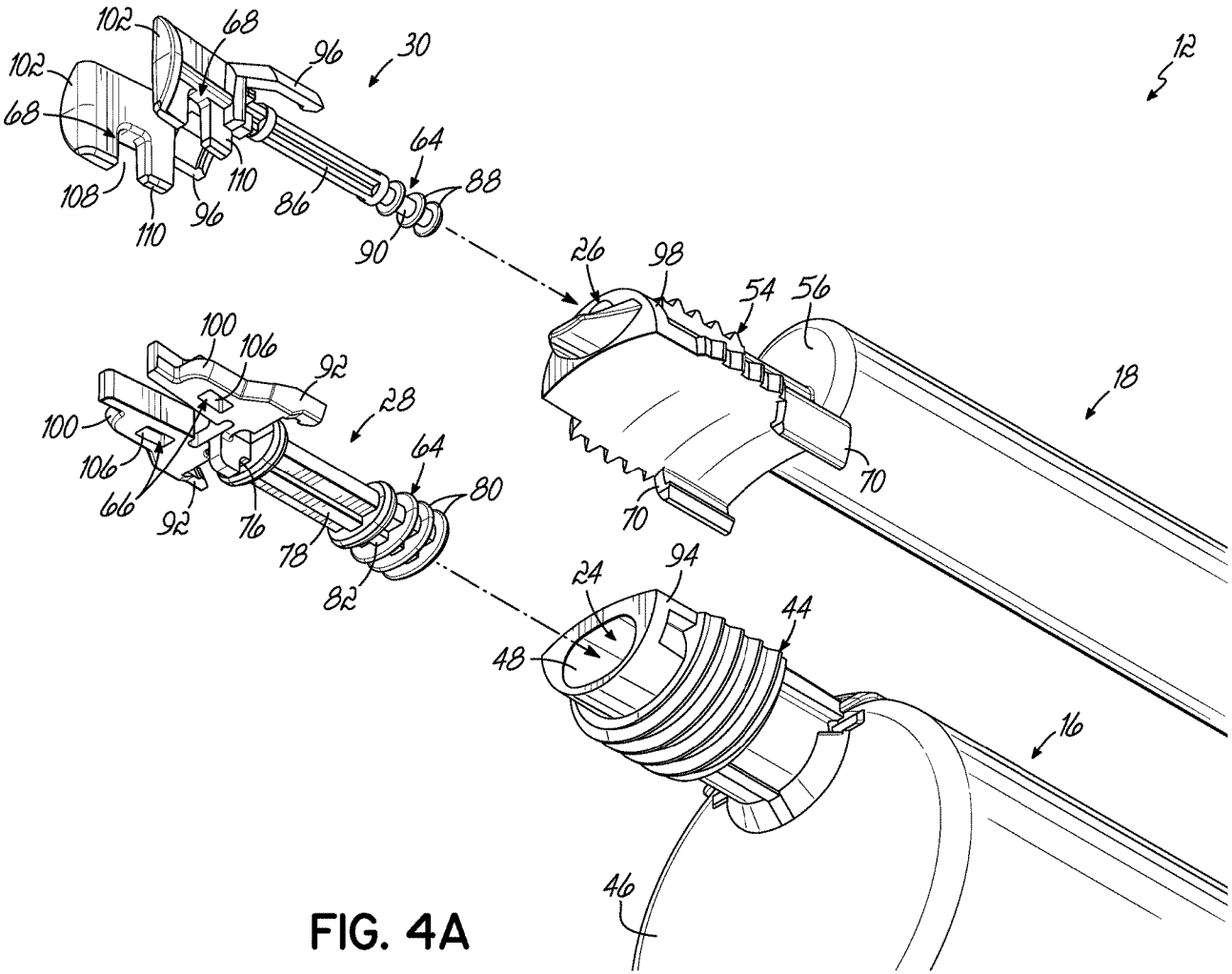
FIG. 4A is a lower perspective view of the multi-component cartridge assembly shown in FIG. 3A.
Figure 4B:
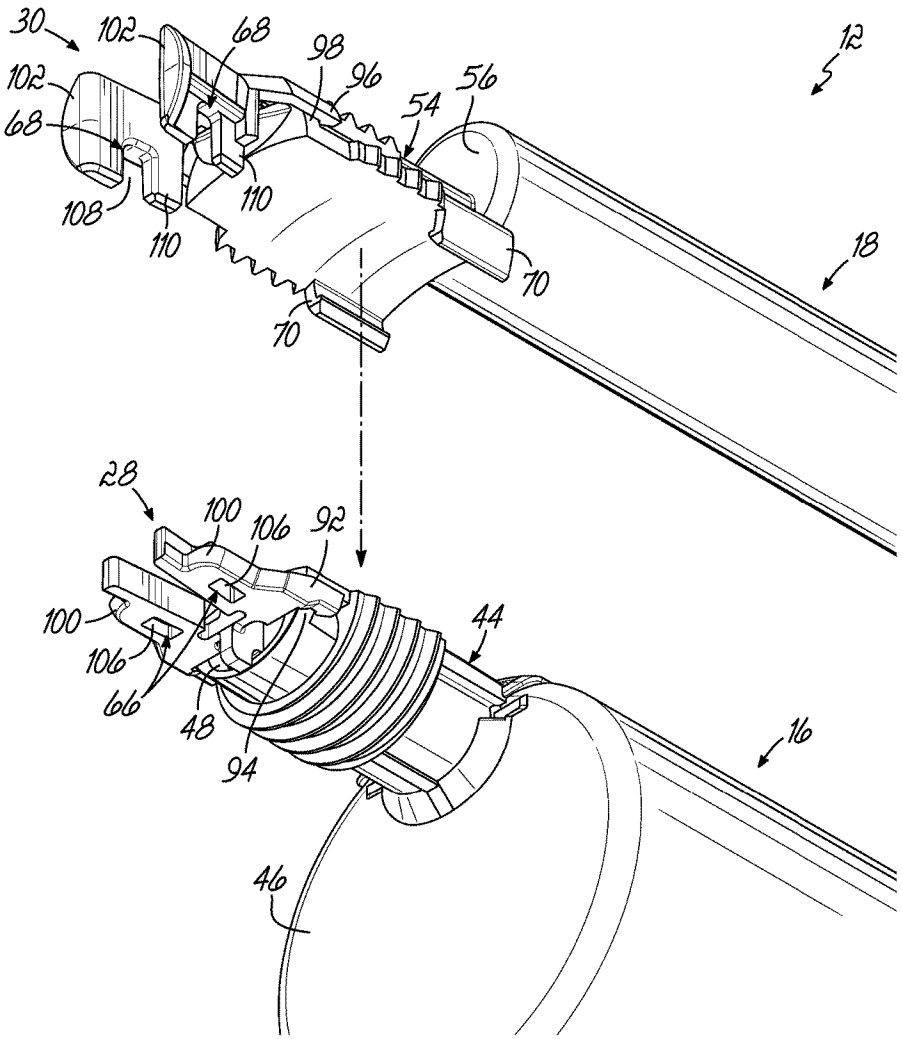
FIG. 4B is a lower perspective view of the pair of closures and the pair of cartridges shown in FIG. 3B.
Figure 4C:
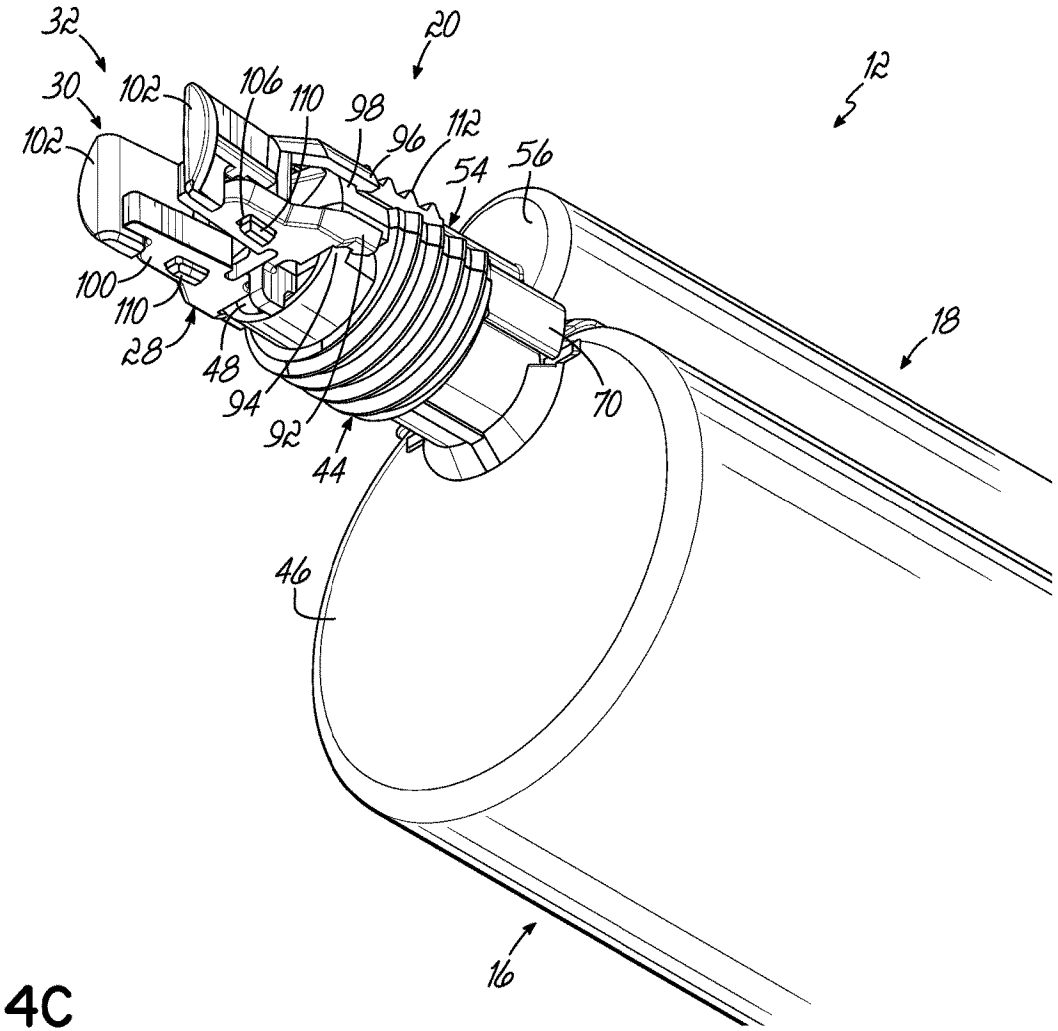
FIG. 4C is a lower perspective view of the pair of cartridges and the closure assembly of FIG. 3C.
Figure 4D:
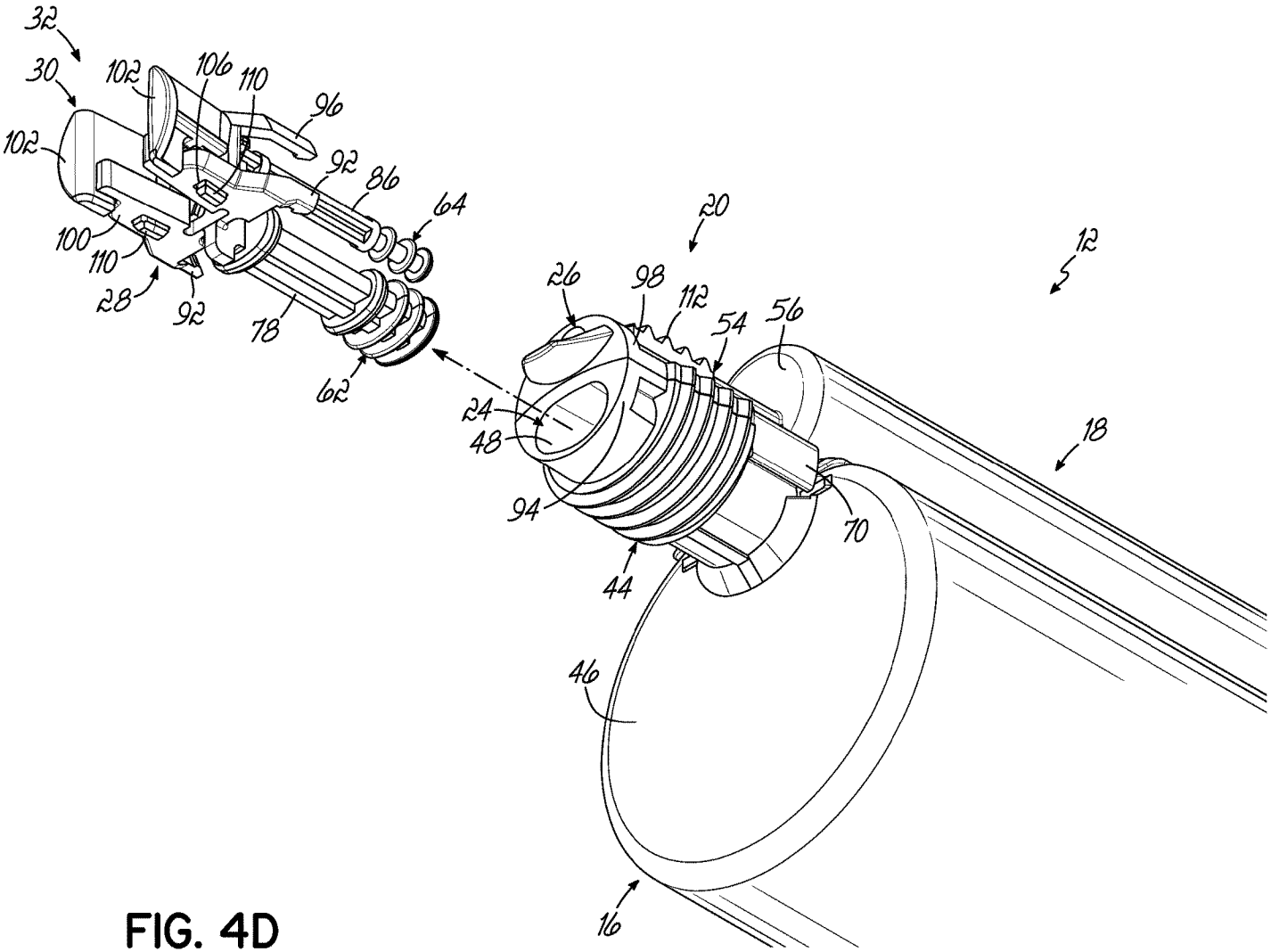
FIG. 4D is a lower perspective view of the closure assembly and the pair of cartridges shown in FIG. 3D.

With reference to FIG. 1 and FIG. 2, a first exemplary embodiment of a fluid cartridge system 10 for dispensing a first fluid and a second fluid includes a multi-component cartridge assembly 12 cradled by a dispensing applicator 14. The multi-component cartridge assembly 12 includes a resin cartridge 16, which contains a fluid resin component, and an activator cartridge 18, which contains a fluid activator component. The resin and activator cartridges 16, 18 form a neck 20 projecting from a proximal end portion 22 of the multi-component cartridge assembly 12 that includes a resin outlet 24 and an activator outlet 26. According to the exemplary embodiment, the resin and activator outlets 24, 26 are more particularly resin and activator neck outlets 24, 26. Each of the resin and activator neck outlets 24, 26 respectively receive a resin closure 28 and an activator closure 30 for fluidly sealing neck outlets 24, 26 and improving the shelf life of the fluid resin and fluid activator components. In anticipation of dispensing the fluid resin and fluid activator components, the resin cartridge 16 secures to the activator cartridge 18 in a side-by-side configuration. In addition, the resin and activator closures 28, 30 operatively connect to form a closure assembly 32. According to the exemplary embodiment, the resin and activator closures 28, 30 operatively connect together while the resin cartridge 16 simultaneously secures to the activator cartridge 18. Alternatively, the resin and activator closure 28, 30 may operatively connect before or after the resin and activator cartridges 16, 18 are connected. The closure assembly 32 collectively removes from the resin and activator neck outlets 24, 26 for simply and effectively preparing the multi-component cartridge assembly 12 for use with the dispensing applicator 14. As used herein, it will be appreciated that the terms "proximal" and "distal" are intended to provide relative locations along exemplary embodiments of the fluid cartridge system 10. It is not intended that the term "proximal" and "distal" limit the invention as described herein.

As shown in FIG. 1 and FIG. 2, with the closure assembly 32 removed, the operator fluidly connects a nozzle 34 to the neck 20 and actuates a pair of pistons 36, 38 received within a distal end portion 40 of the multi-component cartridge assembly 12 via a drive rod 41. The pistons 36, 38 force the fluid resin and fluid activator components from the multi-component cartridge assembly 12 and through the nozzle 34 for dispensing the fluid resin and fluid activator components from the nozzle 34 for application on a substrate (not shown). The nozzle 34 is configured to mix the fluid resin and fluid activator components for application on the substrate such that the fluid resin and fluid activator components react together as will be appreciated by one of ordinary skill. It will be appreciated that alternative nozzles for any desirable dispensing of fluids may be similarly used. Similarly, the fluid cartridge system 10 includes two liquids in the form of the fluid resin and fluid activator components. However, it will be appreciated that alternative embodiments may include alternative fluid components or even more than two fluid components for application on the substrate. Therefore, the invention is not intended to be limited to mixing and dispensing two fluid resin and fluid activator components as shown and described herein.

Figure 5A:
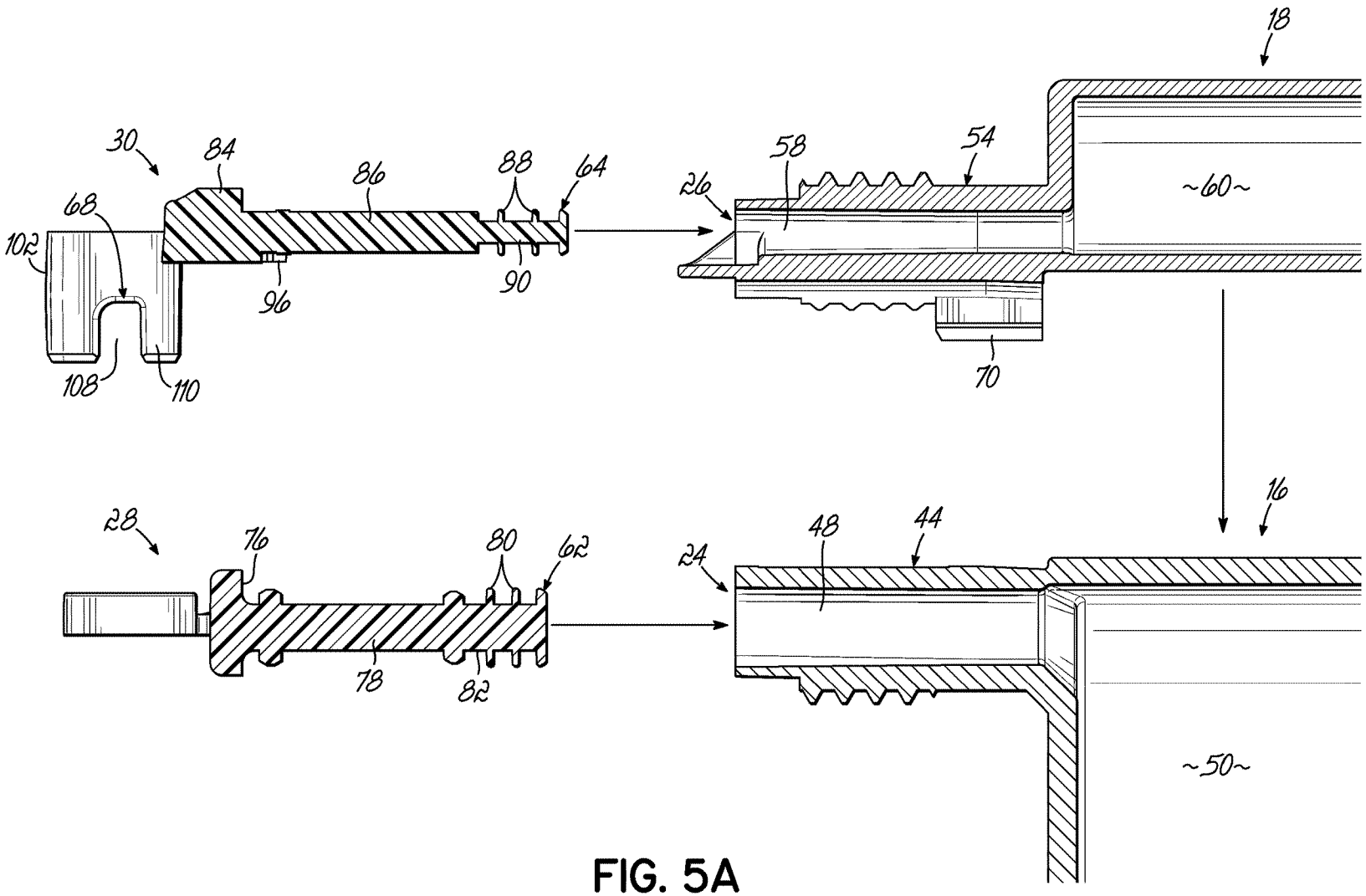
FIG. 5A is an axial cross-section view of the multi-component cartridge assembly shown in FIG. 3A.
Figure 5B:
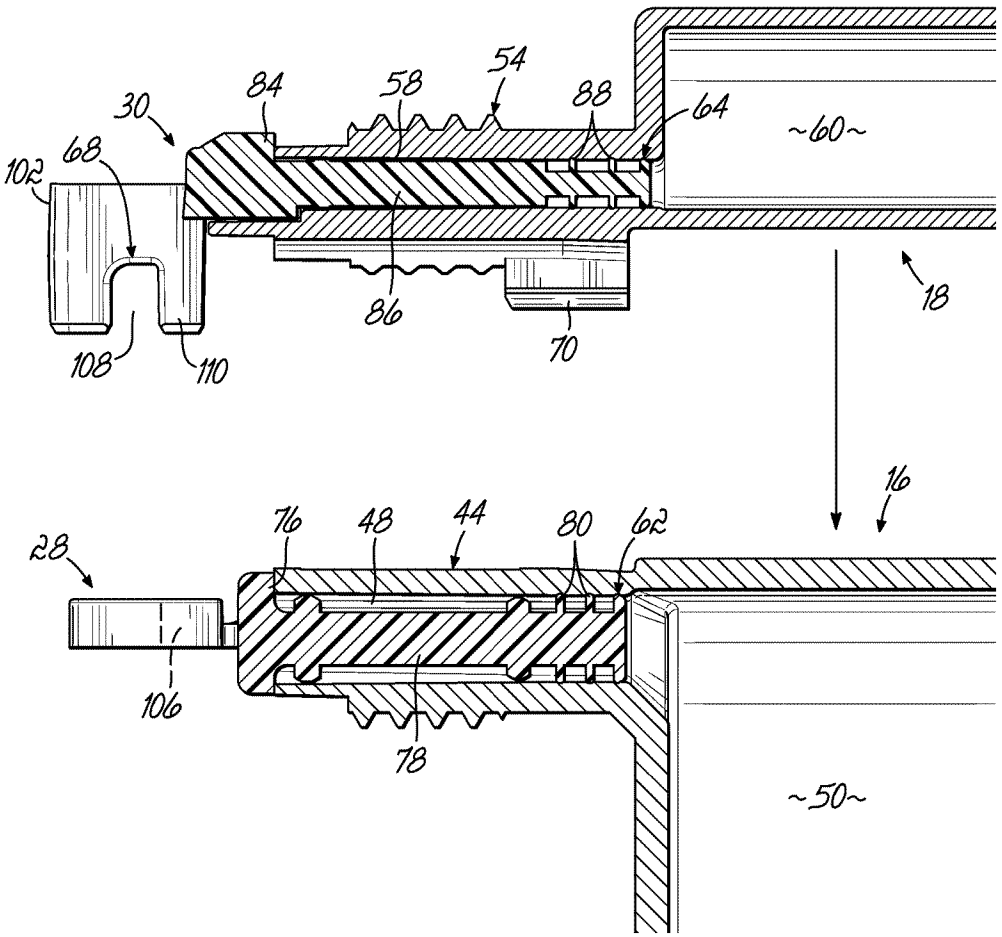
FIG. 5B is an axial cross-section view of the pair of closures and the pair of cartridges shown in FIG. 3B.
Figure 5C:
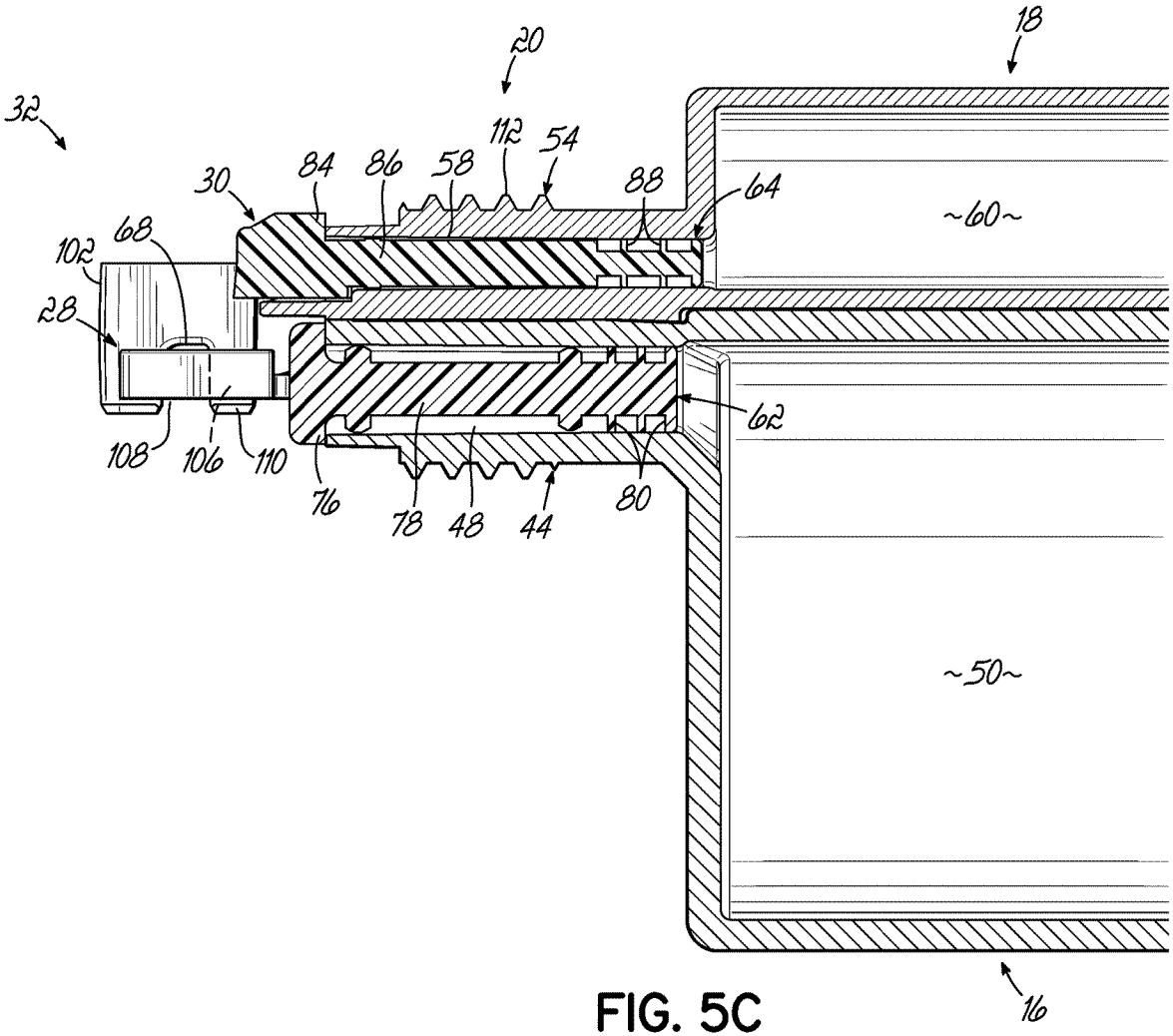
FIG. 5C is an axial cross-section view of the pair of cartridges and the closure assembly of FIG. 3C.
Figure 5D:
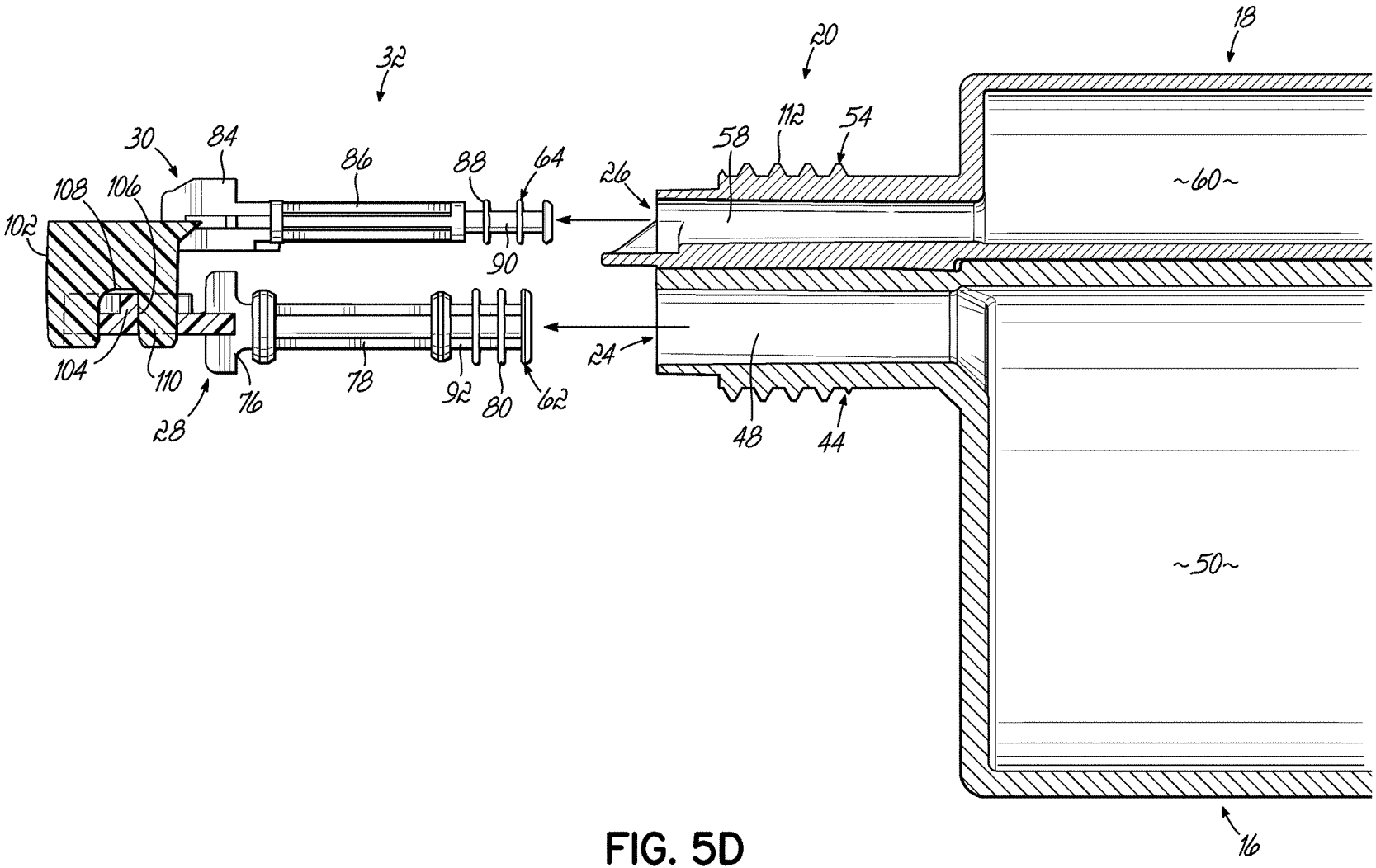
FIG. 5D is an axial cross-section view of the closure assembly and the pair of cartridges shown in FIG. 3D.

The resin and activator cartridges 16, 18 of the multi-component cartridge assembly 12 are shown in FIG. 2 prior to assembly. The resin cartridge 16 includes a resin cartridge body 42 having a resin neck portion 44 extending proximally from a proximal wall 46 of the resin cartridge body 42. The resin neck portion 44 includes a resin outlet passage 48 that fluidly connects to a resin chamber 50 (see FIG. 5A) within the resin cartridge body 42 and further defines the resin neck outlet 24. Similarly, the activator cartridge 18 includes an activator cartridge body 52 having an activator neck portion 54 extending proximally from a proximal wall 56 of the activator cartridge body 52. The activator neck portion 54 includes an activator outlet passage 58 that fluidly connects to an activator chamber 60 (see FIG. 5A) within the activator cartridge body 52 and further defines the activator neck outlet 26.

The resin closure 28 includes a resin plug 62 projecting therefrom such that the resin plug 62 fluidly seals the resin neck outlet 24. The activator closure 30 also includes an activator plug 64 projecting therefrom such that the activator plug 64 fluidly seals the activator neck outlet 26. The resin and activator closures 28, 30 are separate from each other within the respective resin and activator neck portions 44, 54. However, the resin and activator closures 28, 30 each include respective resin and activator closure coupling elements 66, 68 configured to cooperate and interlock to form the closure assembly 32 while the resin cartridge 16 secures to the activator cartridge 18.

The resin cartridge body 42 secures directly against the activator cartridge body 52 such that the resin cartridge body 42 and the activator cartridge body 52 extend generally parallel with each other in the side-by-side configuration. The activator neck portion 54 of the activator cartridge 18 includes a pair of neck snaps 70 configured to engage the resin neck portion 44 of the resin cartridge 16. In addition, the distal end portion 40 of the activator cartridge body 52 includes a tab 72 configured to engage a slot 74. The operator selectively connects the neck snaps 70 and the tab 72 respectively to the resin neck portion 44 and the slot 74 by moving the resin and activator cartridges 16, 18 in a transverse direction toward each other, as indicated by arrow 75. Simultaneously, the resin and activator closure coupling elements 66, 68 interlock to form the closure assembly 32 for collective removal. It will be appreciated that alternative structures for securing the activator cartridge 18 relative to the resin cartridge 16 may also be used in accordance with the invention. By way of example, the multi-component cartridge assembly 12 and alternative embodiments having a resin cartridge secured to an activator cartridge are described in additional detail in International Patent Application Publication No. WO 2017/165730 A1 to Dean et al., entitled "Side-By-Side Cartridge Assembly for Dispensing a First Fluid and a Second Fluid", the disclosure of which is hereby incorporated by reference herein. According tothe exemplary embodiment, the resin cartridge 16 is generally larger than the activator cartridge 18 and has the resin neck outlet 24 similarly larger than the activator neck outlet 26 for discharging the fluid resin component at a larger ratio relative to the fluid activator component. However, it will be appreciated that the relative sizes and ratios of the cartridges may vary and, as such, the invention is not intended to be limited to the approximate sizes and ratios shown and described herein.

FIGS. 3A through 5D show the assembly of the resin and activator closures 28, 30 to form the closure assembly 32 in additional detail. The resin closure 28 includes a resin base section 76 and a resin extension 78 extending distally from the resin base section 76. The resin extension 78 extends to the resin plug 62, which includes a plurality of resin seal members 80 surrounding a resin plug core 82. The resin seal members 80 are generally transverse to the resin plug core 82 and sized to engage an inner surface of the resin outlet passage 48. Each of the resin seal members 80 fluidly seals against the inner surface of the resin outlet passage 48 and inhibits entrapment of air within the resin outlet passage 48 upon installation of the resin closure 28.

The activator closure 30 also includes an activator base section 84 and an activator extension 86 extending distally from the activator base section 84. The activator extension 86 extends to the activator plug 64, which includes a plurality of activator seal members 88 surrounding an activator plug core 90. The activator seal members 88 are generally transverse to the activator plug core 90 and sized to engage an inner surface of the activator outlet passage 58. Each of the activator seal members 88 fluidly seals against the inner surface of the activator outlet passage 58 and inhibits entrapment of air within the activator outlet passage 58 upon installation of the activator closure 30.

The resin and activator closures 28, 30 removably connect to the neck 20 for inhibiting inadvertent removal of the resin and activator plugs 62, 64 from the resin and activator neck outlets 24, 26, respectively. More particularly, the resin closure 28 includes a pair of opposing resin snap members 92 extending distally from the resin base section 76. The pair of resin snap members 92 cooperate with a pair of resin neck collars 94 such that the resin snap members 92 are generally biased and snap over the resin neck collars 94 to hold the resin base section 76 against the resin neck portion 44. Similarly, the activator closure 30 includes a pair of opposing activator snap members 96 extending distally from the activator base section 84. The activator snap members 96 cooperate with a pair of activator neck collars 98 such that the activator snap members 96 are generally biased and snap over the activator neck collars 98 to hold the activator base section 84 against the activator neck portion 54.

In addition, the resin and activator base sections 76, 84 respectively include a pair of resin levers 100 and a pair of activator levers 102 configured to disengage the resin and activator snap members 92, 96 from the neck 20. The resin levers 100 oppose each other and project proximally from the resin base section 76. More particularly, the resin levers 100 extend proximally from respective resin snap members 92 such that the resin levers 100 and resin snap members 92 are biased and pivot about the resin base section 76. The activator levers 102 also oppose each other and project proximally from the activator base section 84. The activator levers 102 extend proximally from respective activator snap members 96 such that the activator levers 102 and activator snap members 96 are biased and pivot about the activator base section 84. During use, the operator pivots the pair of resin levers 100 and the pair of activator levers 102 respectively inward toward each other and, in turn, pivots the pair of resin snap members 92 and the pair of activator snap members 96 outward. With each of the resin and activator snap members 92, 96 disengaged from the resin and activator neck collars 94, 98, the operator may remove the closure assembly 32 from the neck 20.

With respect to the closure assembly 32, the resin closure 28 and the activator closure 30 interlock via the resin and activator closure coupling elements 66, 68 for collective and simultaneous removal. Each of the resin levers 100 includes the resin closure coupling element 66, whereas each of the activator levers 102 includes the activator closure coupling element 68. The resin closure coupling element 66 is a resin tongue 104 and a resin groove 106 defined by each of the resin levers 100. The activator closure coupling element 68 is an activator groove 108 and an activator tongue 110 defined by each of the activator levers 102. The resin and activator grooves 106, 108 are each configured to receive and interlock with the resin and activator tongues 104, 110 as the resin closure 28 transversely approaches the activator closure 30, as indicated by the arrow 75. The resin closure 28 interlocks with the activator closure 30 such that the operator simultaneously squeezes each of the resin and activator levers 100, 102 together to disengage and remove the resin and activator snap members 96 from the neck 20.

The resin and activator neck portions 44, 54 define a plurality of threads 112 that cooperate to receive the nozzle 34 (see FIG. 1) once the operator removes the closure assembly 32 from the neck 20. However, it will be appreciated that the nozzle 34 (see FIG. 1) may be alternatively connected to the neck 20 for dispensing the fluid resin component and the fluid activator component via the dispensing applicator 14 (see FIG. 1).

Figure 6:
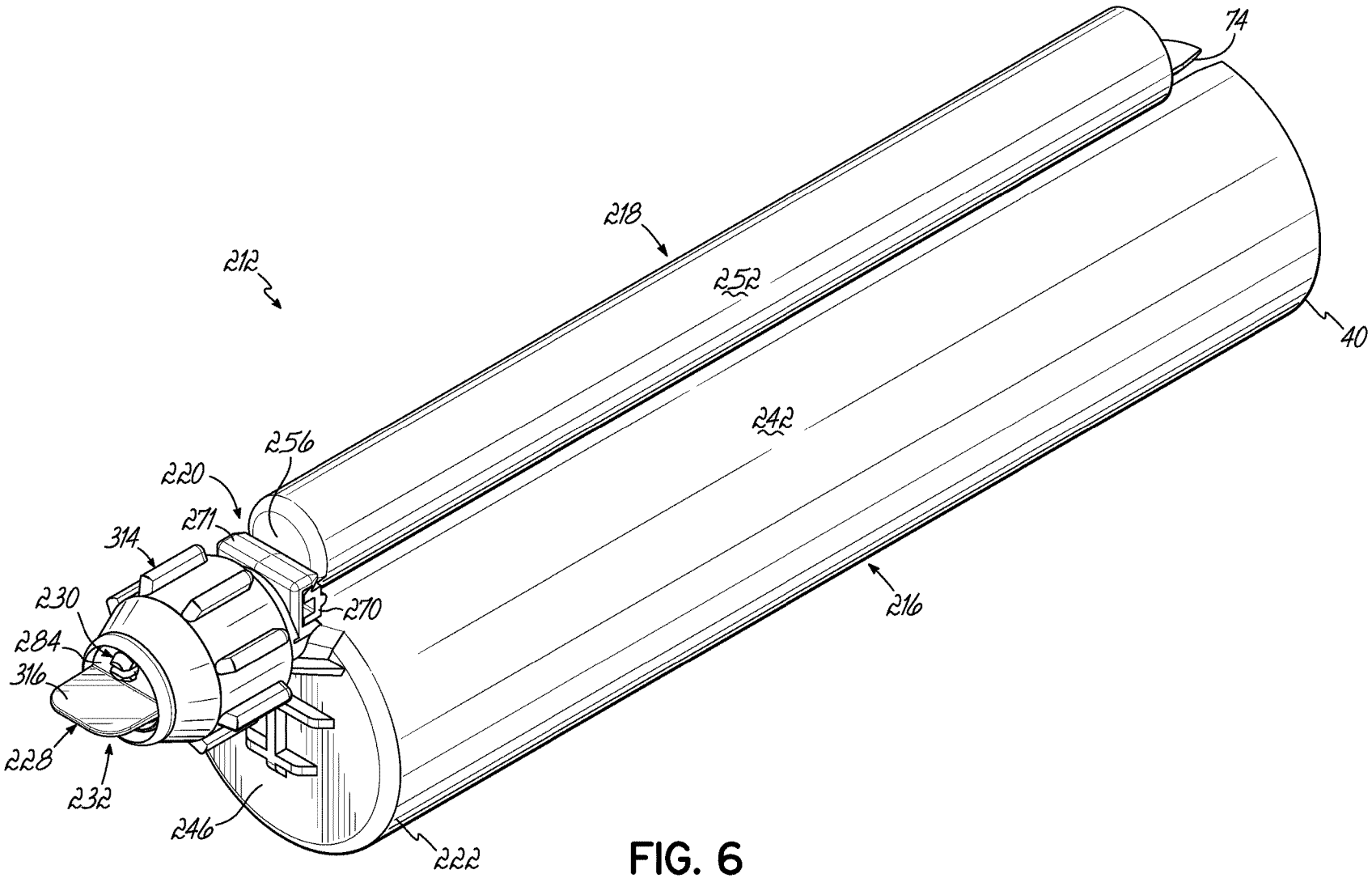
FIG. 6 is an upper perspective view of a second embodiment of a multi-component cartridge assembly.
Figure 7:
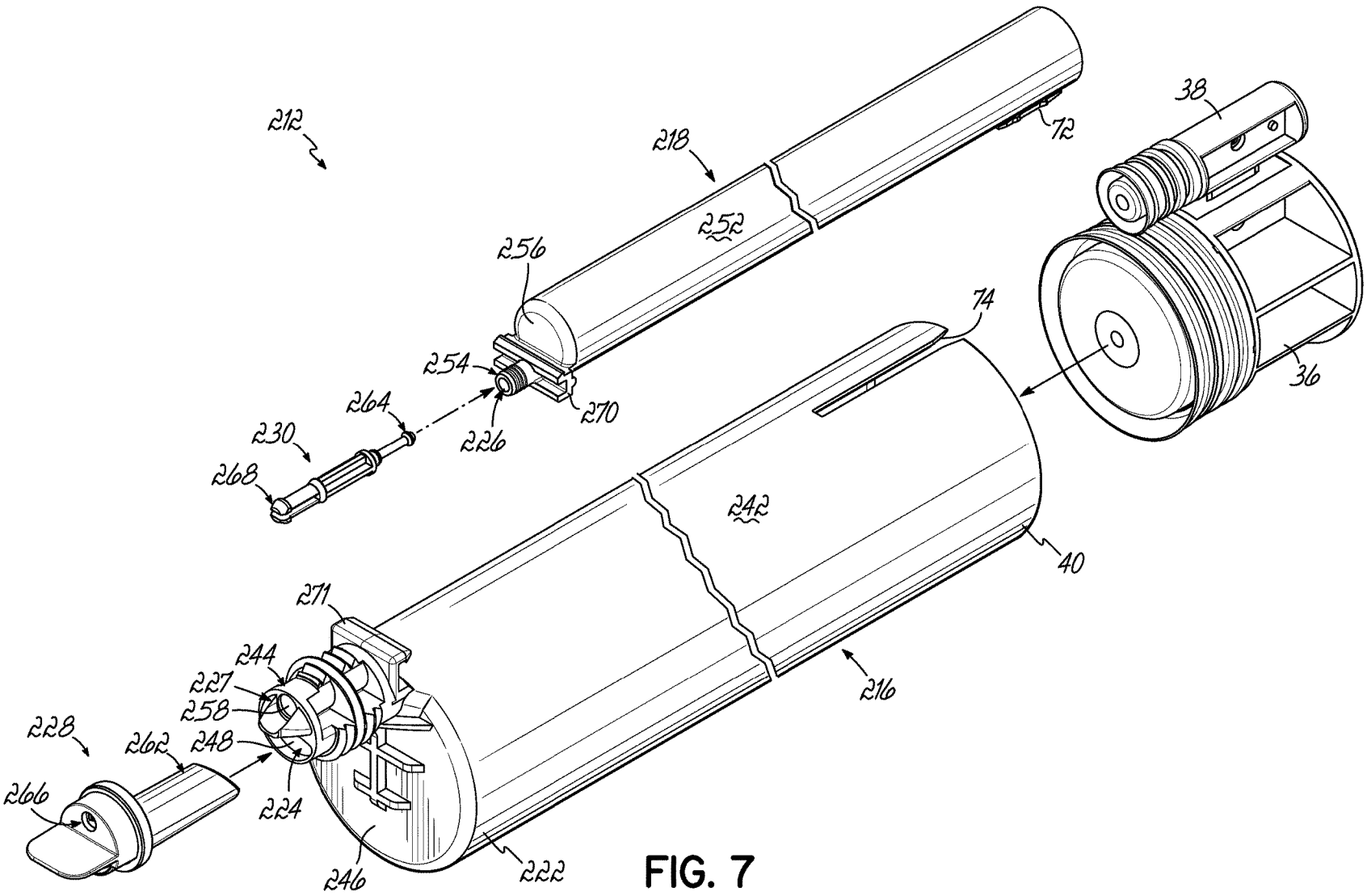
FIG. 7 is an upper exploded perspective view of the multi-component cartridge assembly shown in FIG. 6.

With reference to FIG. 6 and FIG. 7, a second exemplary embodiment of a multi-component cartridge assembly 212 for being cradled by the dispensing applicator 14 (see FIG. 1) includes a resin cartridge 216 and an activator cartridge 218. The resin and activator cartridges 216, 218 form a neck 220 projecting from a proximal end portion 222 of the multi-component cartridge assembly 212 that includes a resin outlet 224 and an activator outlet 226. The resin outlet 224 is in the form of a resin neck outlet 224, and the activator outlet 226 is in the form of an activator stem outlet 226. In addition, the neck 220 also includes an activator neck outlet 227. Each of the resin neck outlet 224 and the activator stem outlets 224, 226 respectively receives a resin closure 228 and an activator closure 230 for fluidly sealing outlets 224, 226 and improving the shelf life of the fluid resin and fluid activator components prior to use. In anticipation of dispensing the fluid resin and fluid activator components, the resin cartridge 216 secures to the activator cartridge 218 in the side-by-side configuration. In addition, the resin and activator closures 228, 230 operatively connect to form a closure assembly 232. According to an exemplary embodiment, the resin and activator closures 228, 230 operatively connect simultaneously while securing the resin cartridge 216 to the activator cartridge 218. Alternatively, the resin and activator closure 228, 230 may operatively connect before or after the resin and activator cartridges 216, 218 are connected. The operator collectively removes the closure assembly 232 from the resin neck outlet 224 and the activator stem outlet 226. With regard to the first embodiment of the multi-component cartridge assembly 12 (see FIG. 2) and the second embodiment of the multi-dispensing cartridge assembly 212, like numbers below indicate like features also described above.

Figure 9A:
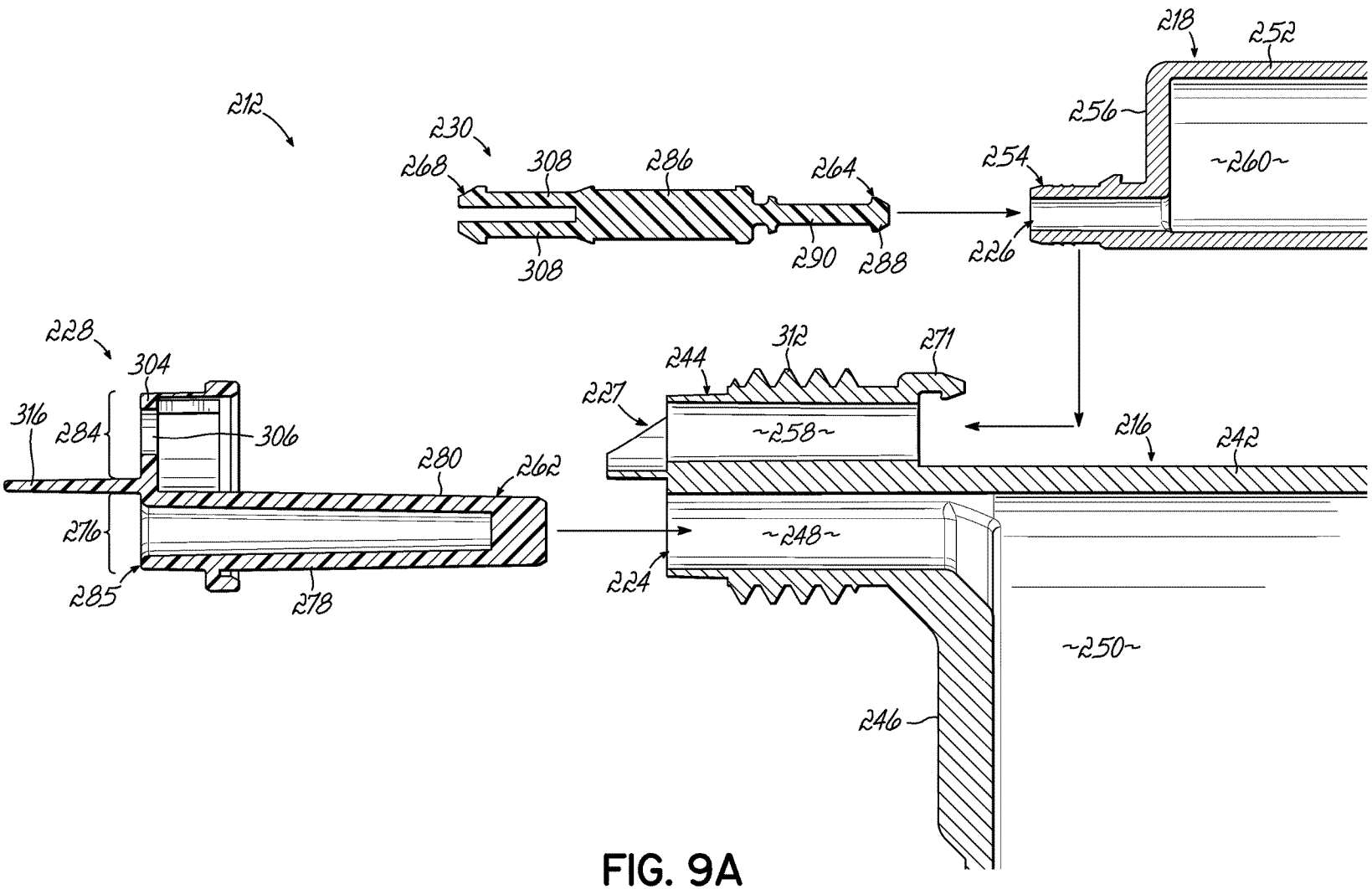
FIG. 9A is an axial cross-section view of the multi-component cartridge assembly shown in FIG. 8A.
Figure 9B:
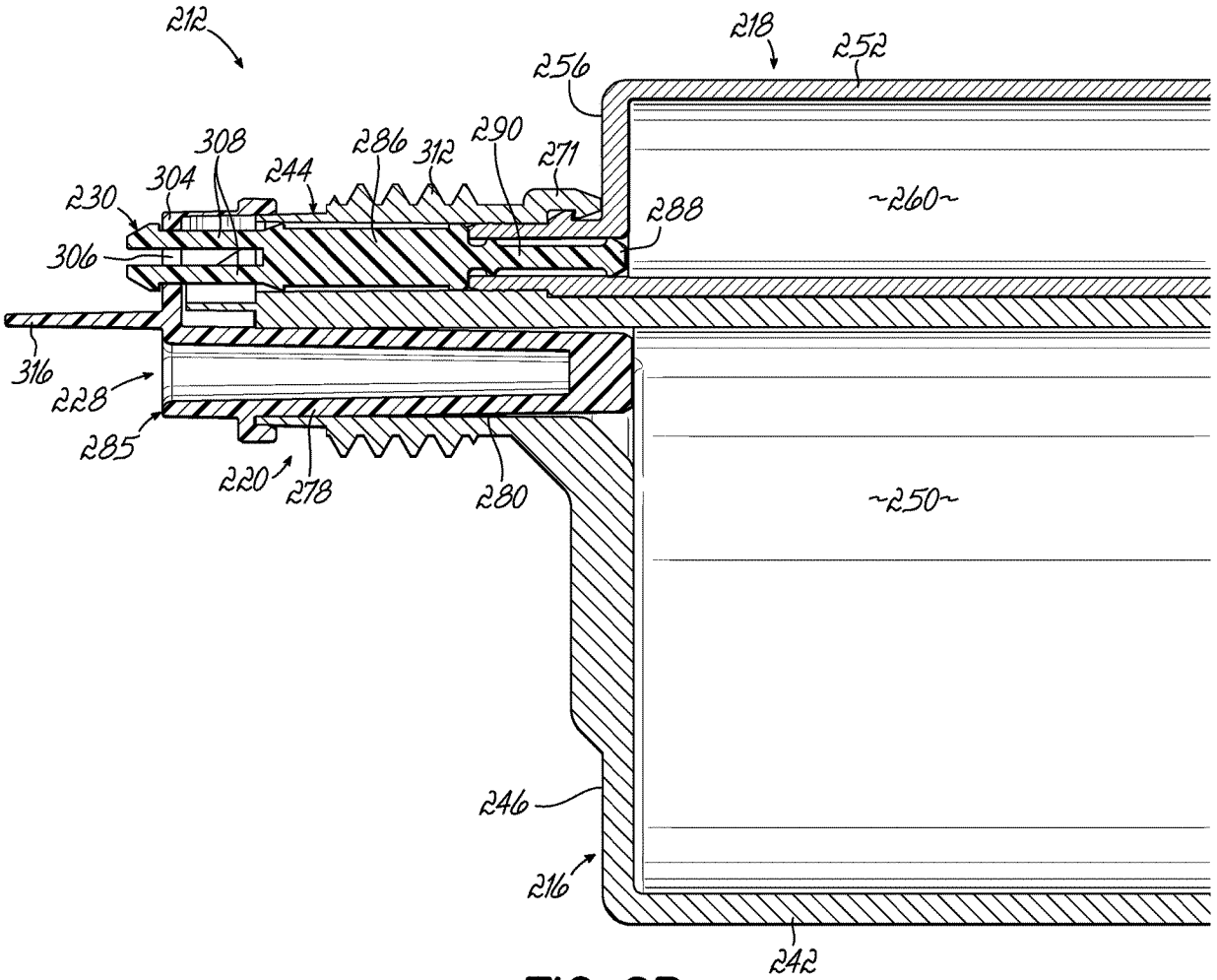
FIG. 9B is an axial cross-section view of the pair of closures and the pair of cartridges shown in FIG. 8C.
Figure 9C:
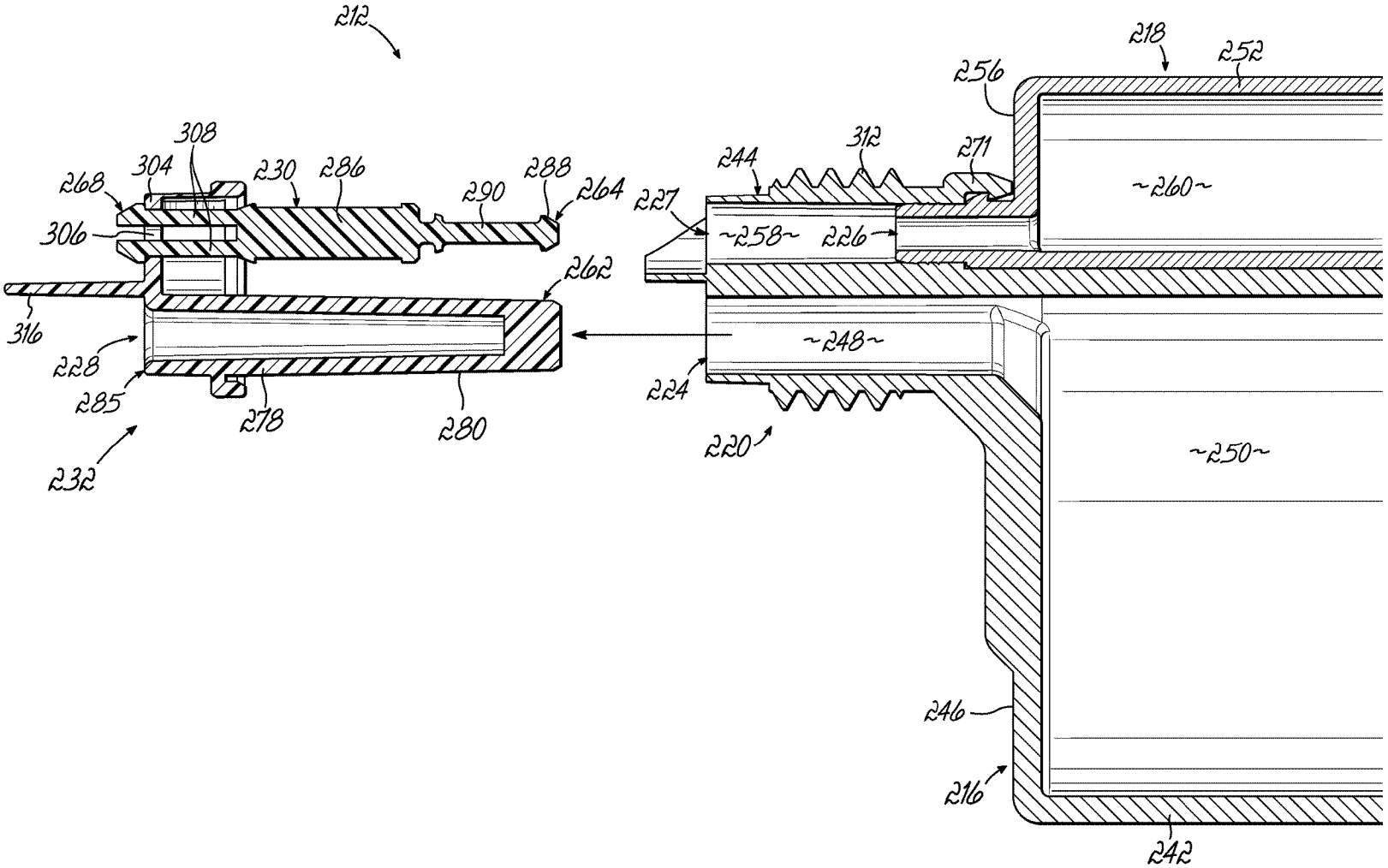
FIG. 9C is an axial cross-section view of the pair of cartridges and the closure assembly of FIG. 8D.

The resin and activator cartridges 216, 218 of the multi-component cartridge assembly 212 are shown in FIG. 7 prior to assembly. The resin cartridge 216 includes a resin cartridge body 242 having a resin neck portion 244 extending proximally from a proximal wall 246 of the resin cartridge body 242. The resin neck portion 244 includes a resin outlet passage 248 that fluidly connects to a resin chamber 250 (see FIG. 9A) within the resin cartridge body 242 and further defines the resin neck outlet 224. The resin neck portion 244 also includes an activator outlet passage 258 extending to activator neck outlet 227. Similarly, the activator cartridge 218 includes an activator cartridge body 252 having an activator neck portion 254 extending proximally from a proximal wall 256 of the activator cartridge body 252. The activator neck portion 254 includes the activator stem outlet 226 that fluidly connects to the activator neck outlet 227 to further define the activator outlet passage 258 upon assembly for fluid communication with the activator chamber 260 (see FIG. 9A).

The resin closure 228 includes a resin plug 262 projecting therefrom such that the resin plug 262 fluidly seals the resin neck outlet 224. The activator closure 230 also includes an activator plug 264 projecting therefrom such that the activator plug 264 fluidly seals the activator neck outlet 226. The resin and activator closures 228, 230 are separate from each other within the respective resin and activator neck portions 244, 254. However, the resin and activator closures 228, 230 each include respective resin and activator closure coupling elements 266, 268 configured to cooperate and interlock to form the closure assembly 232 while securing the resin cartridge 216 to the activator cartridge 218.

Figure 8A:
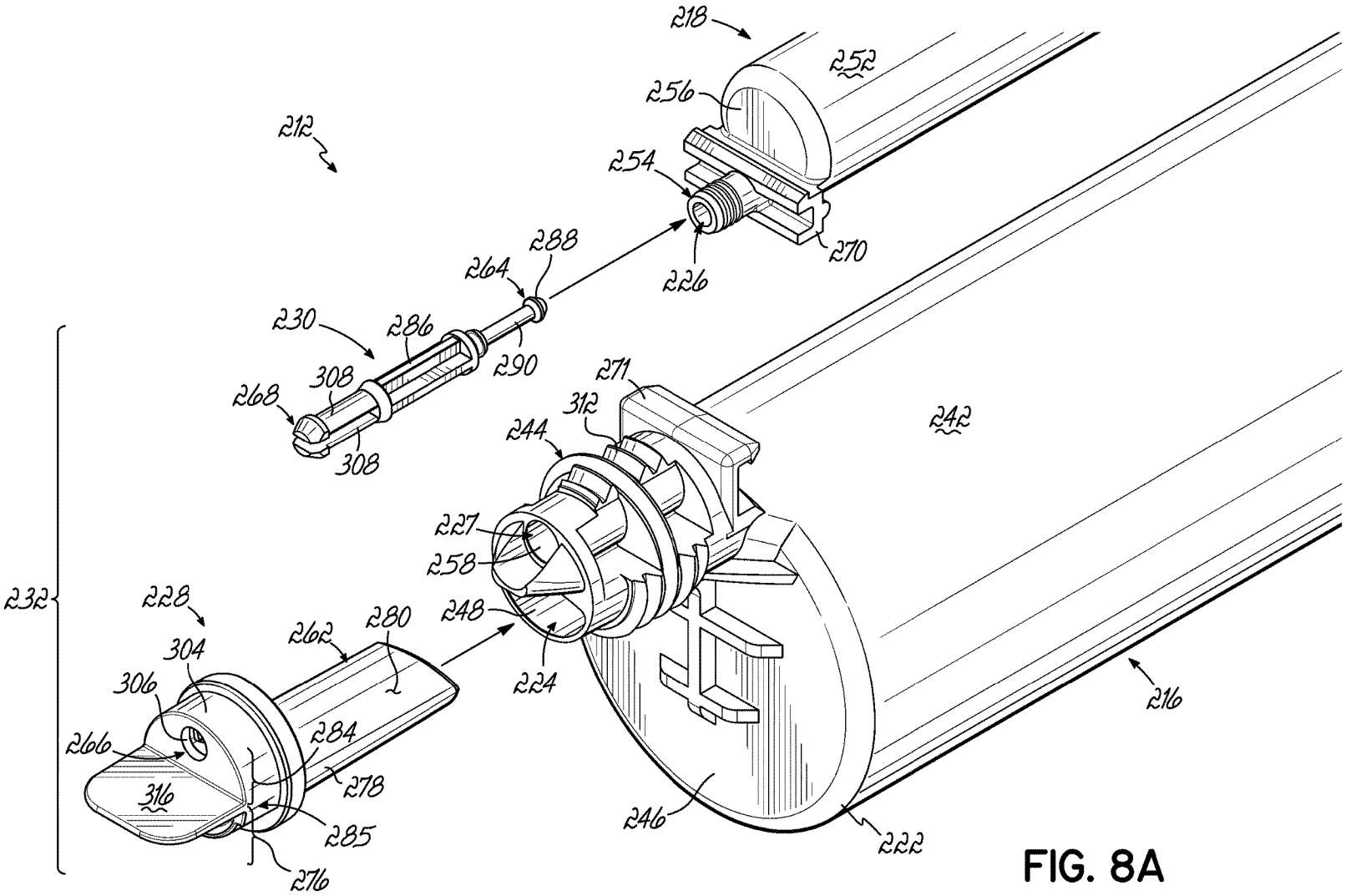
FIG. 8A is an upper enlarged perspective view of the multi-component cartridge assembly shown in FIG. 6.
Figure 8B:
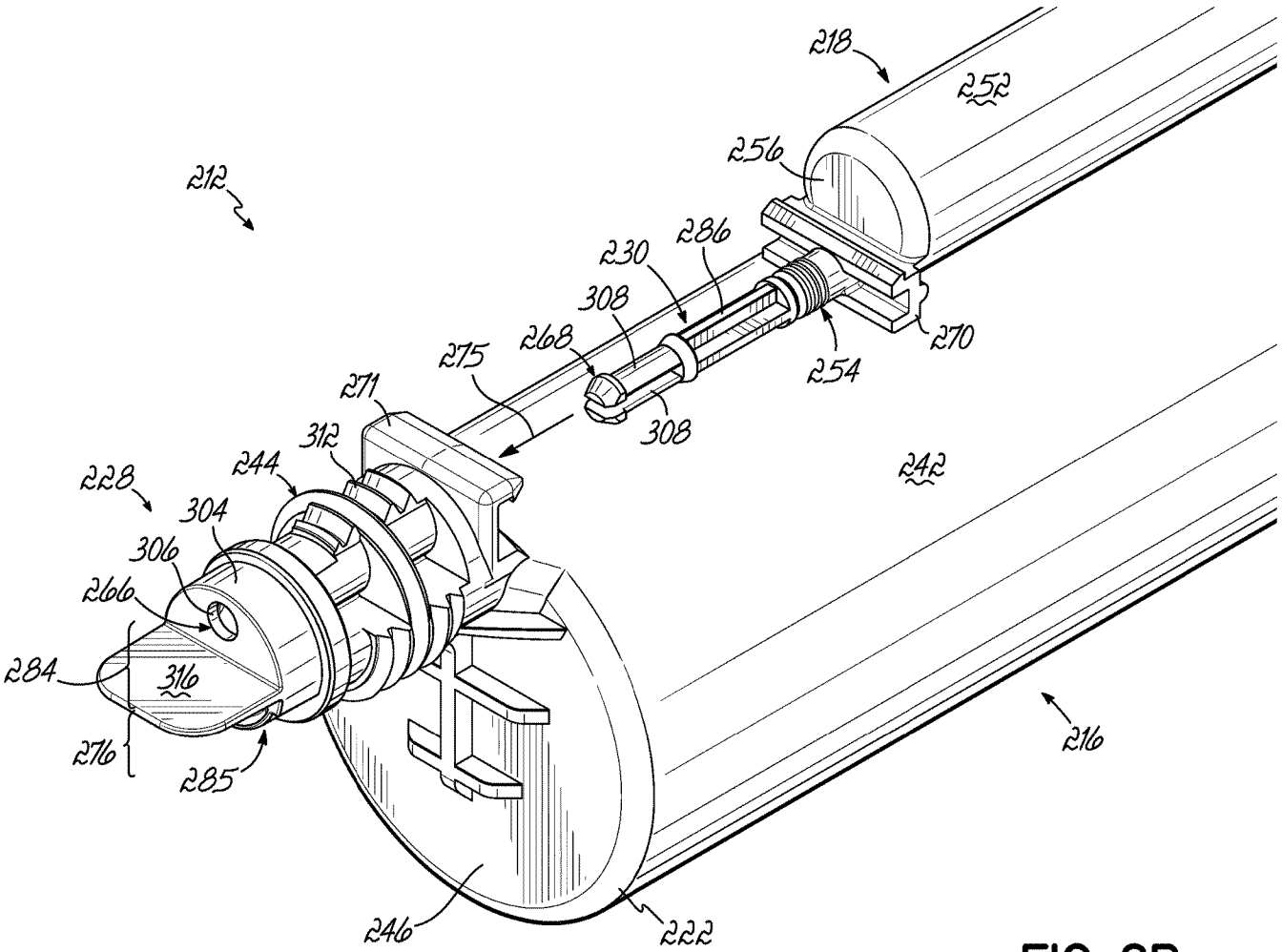
FIG. 8B is an upper perspective view similar to FIG. 8A, but showing a pair of closures respectively connected to a pair of cartridges.
Figure 8C:
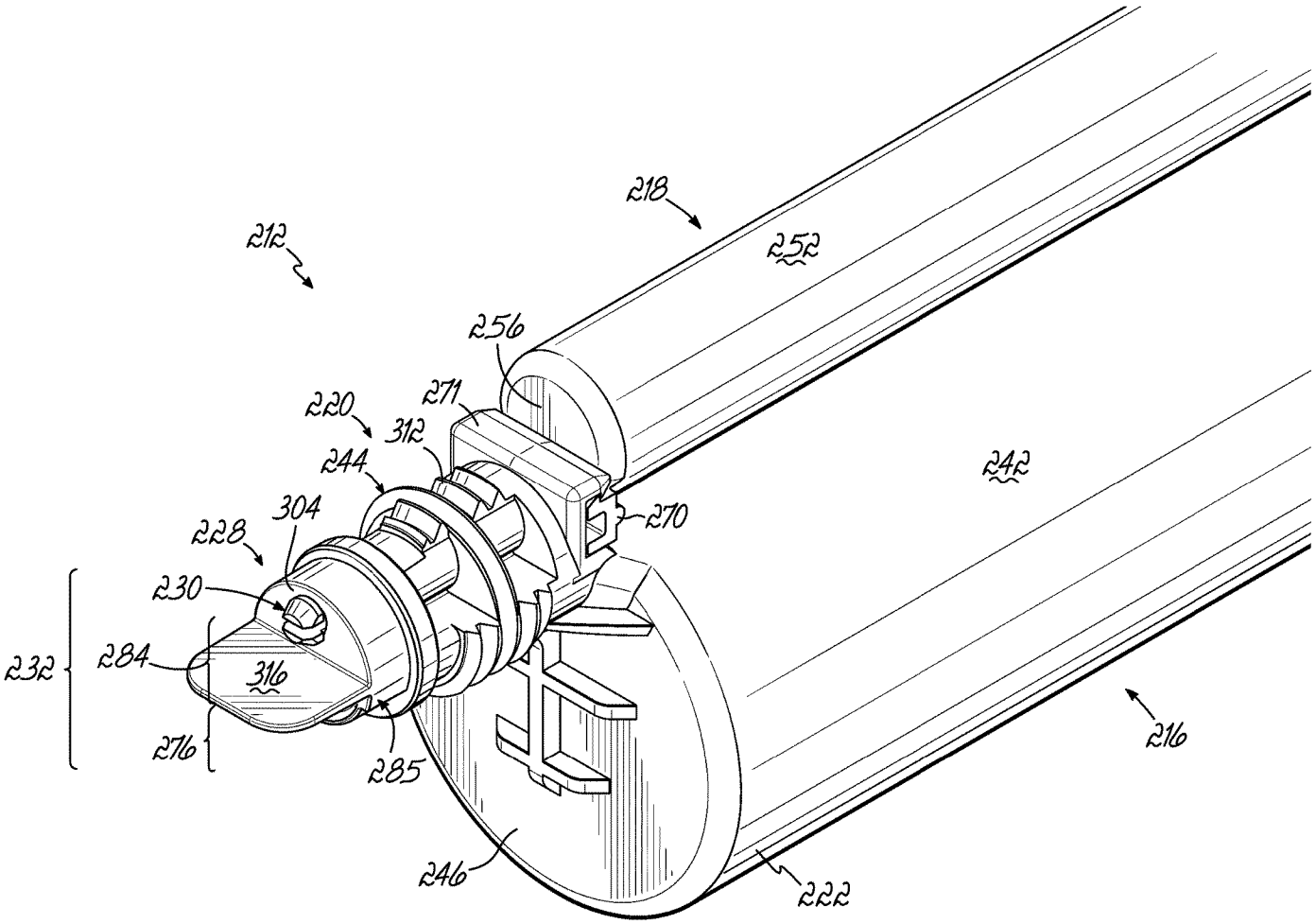
FIG. 8C is an upper perspective view similar to FIG. 8B, but showing the pair of cartridges secured to each other and the pair of closures interlocked to define a closure assembly.
Figure 8D:
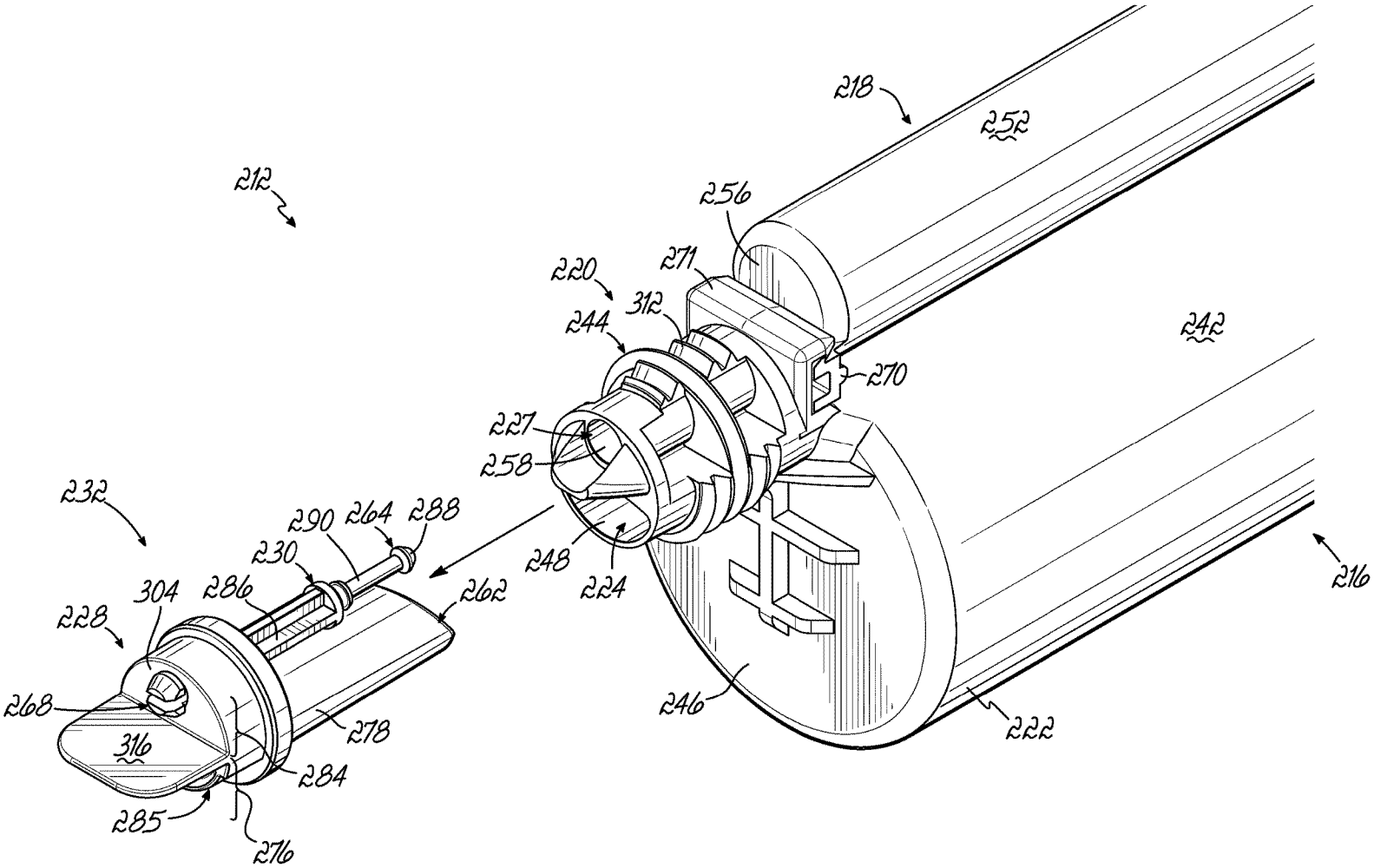
FIG. 8D is an upper perspective view similar to FIG. 8C, but showing the closure assembly removed from the pair of cartridges.

The resin cartridge body 242 secures directly against the activator cartridge body 252 such that the resin and activator cartridge bodies 242 and the activator cartridge body 252 extend generally parallel with each other in the side-by-side configuration. The activator neck portion 254 of the activator cartridge 218 includes a neck clip 270 configured to engage another neck clip 271 of the resin neck portion 244. In addition, the distal end portion 40 of the activator cartridge body 252 includes the tab 72 configured to engage the slot 74. The operator selectively connects the neck clips 270 and the tab 72 respectively to the other neck clip 271 and the slot 74 by moving the resin and activator cartridges 216, 218 in an axial direction toward each other, as indicated by arrow 275 (see FIG. 8B). Simultaneously, the resin and activator closure coupling elements 266, 268 interlock to form the closure assembly 232 for removal. It will be appreciated that alternative structures for securing the activator cartridge 218 relative to the resin cartridge 216 may be used as discussed above in additional detail.

FIGS. 8A through 9C show the assembly of the resin and activator closures 228, 230 to form the closure assembly 232 in additional detail. The resin closure 228 includes a resin base section 276 and a resin extension 278 extending distally from the resin base section 276. The resin extension 278 extends to the resin plug 262, which includes a seal surface 280. The seal surface 280 fluidly seals against the inner surface of the resin outlet passage 248 and inhibits entrapment of air within the resin outlet passage 248 upon installation of the resin closure 228. In addition, the resin closure 228 also includes an activator base section 284 integral and unitarily formed with the resin base section 276. As such, the activator base section 284 and the resin base section 276 form a base 285 that abuts against the neck 220 and covers the resin and activator neck outlets 224, 227.

The activator closure 230 also includes an activator extension 286 extending distally to the activator plug 264, which includes an activator seal member 288 surrounding an activator plug core 290. The activator seal member 288 is sized to engage and fluidly seal against an inner surface of the activator stem outlet 226. In addition, the activator seal member 288 inhibits entrapment of air within the activator outlet passage 258 upon installation of the activator closure 230.

With respect to the closure assembly 232, the resin and activator closure coupling elements 266, 268 interlock for collective and simultaneous removal. The activator base section 284 includes the resin closure coupling element 266 in the form of a wall 304 defining an aperture 306. In addition, the activator extension 286 includes a pair of elongate clips 308 positioned opposite the activator plug 264 and projecting proximally toward the wall 304. Each of the elongate clips 308 is configured to be received within the aperture 306 and engage the wall 304 for interlocking the activator closure 230 to the resin closure 228. The elongate clips 308 and the wall 304 interlock as the activator closure 230 axially moves through the neck 220. The activator closure 230 inserts within the activator outlet passage 258 to engage and interlock with the wall 304, as indicated by arrow 275.

The neck 220 includes a plurality of threads 312 that cooperate with a nut 314. The nut 314 covers at least a portion of each of the resin and activator base sections 276, 284 and holds the resin and activator closures 228, 230 within the resin neck outlet 224 and the activator stem outlet 226. The resin and activator base sections 276, 284 include a handle 316 projecting proximally therefrom to improve a grip of the operator removing the closure assembly 232. With the closure assembly 232 removed, the neck 220 may then receive the nozzle 34 (see FIG. 1) as described above in additional detail for dispensing the fluid resin component and the fluid activator component via the dispensing applicator 14 (see FIG. 1).

Figure 10:
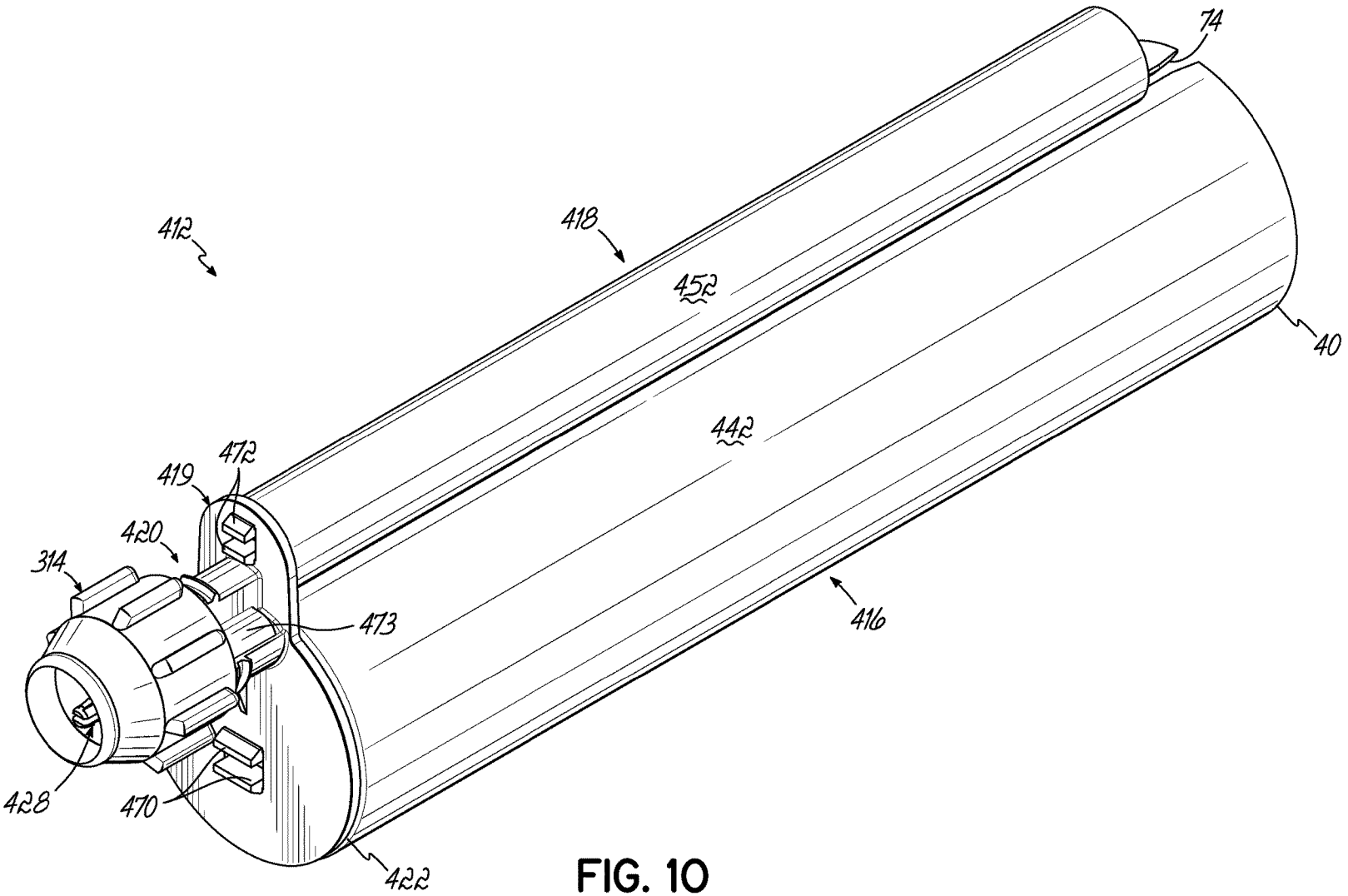
FIG. 10 is an upper perspective view of a third embodiment of a multi-component cartridge assembly.
Figure 11A:
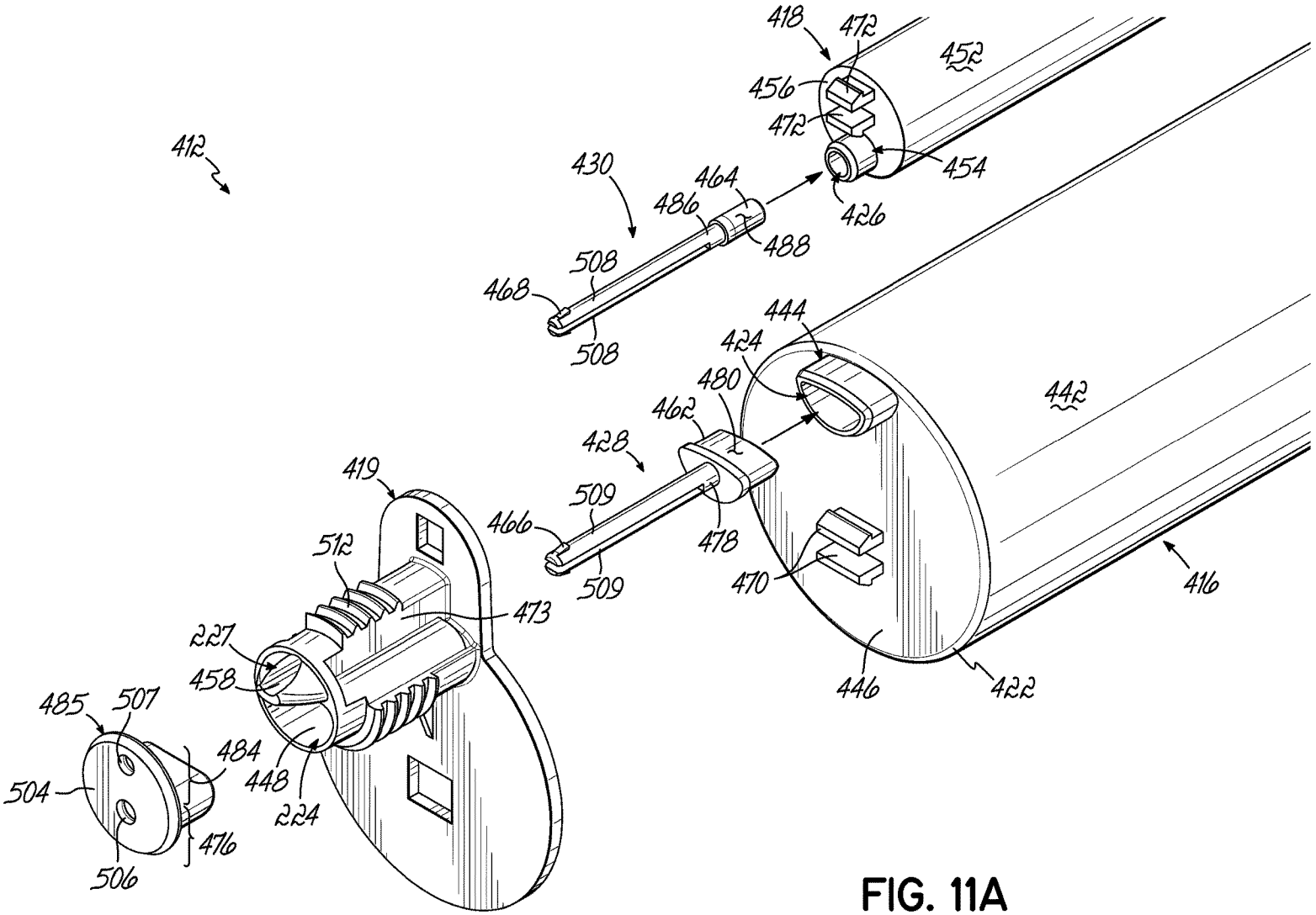
FIG. 11A is an upper enlarged exploded perspective view of the multi-component cartridge assembly shown in FIG. 10.
Figure 11B:
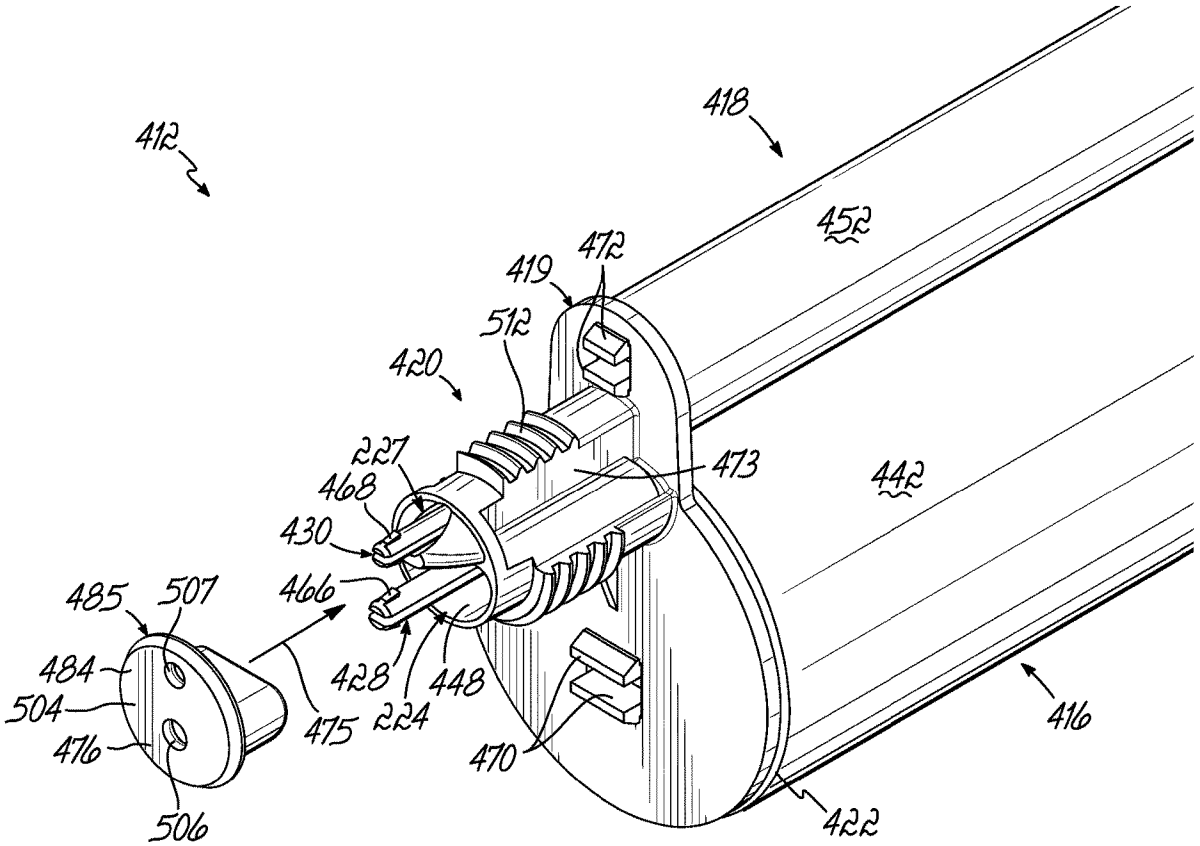
FIG. 11B is an upper perspective view similar to FIG. 11A, but showing a pair of closures respectively connected to a pair of cartridges secured together via a manifold.
Figure 11C:
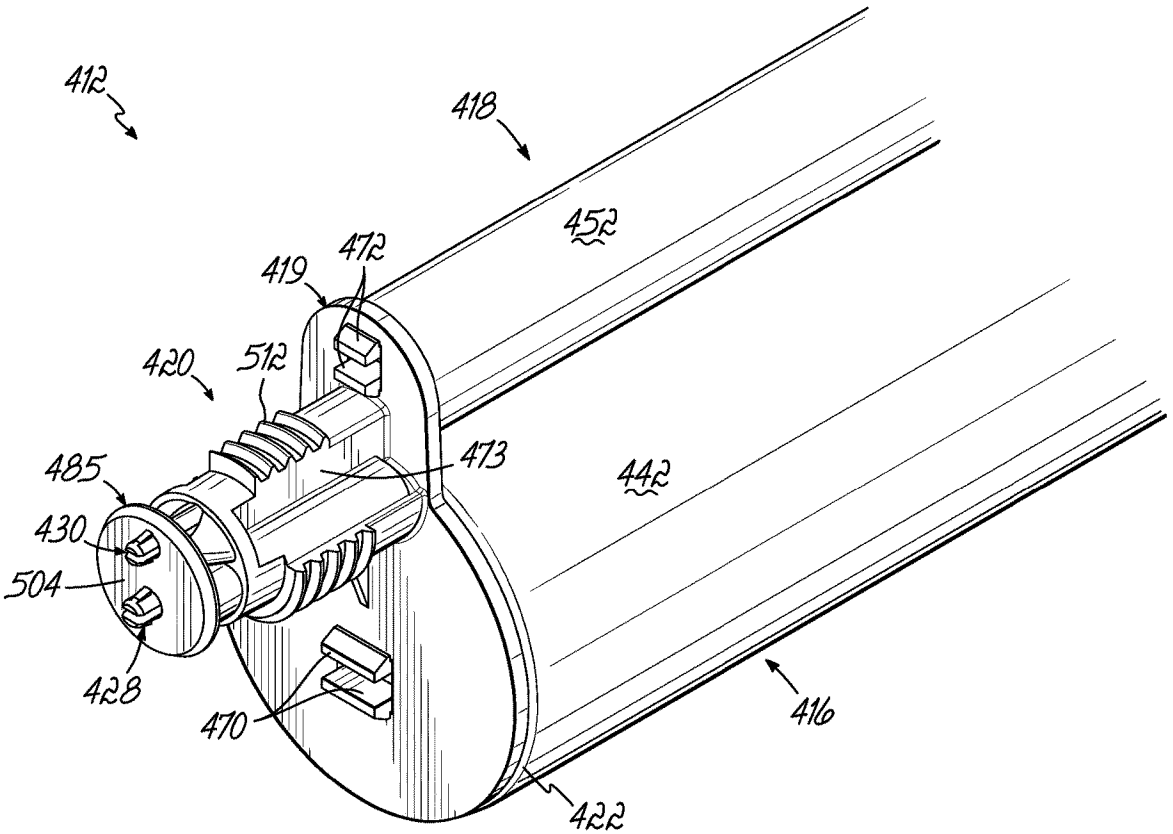
FIG. 11C is an upper perspective view similar to FIG. 11B, but the pair of closures interlocked by a base to define a closure assembly.
Figure 11D:
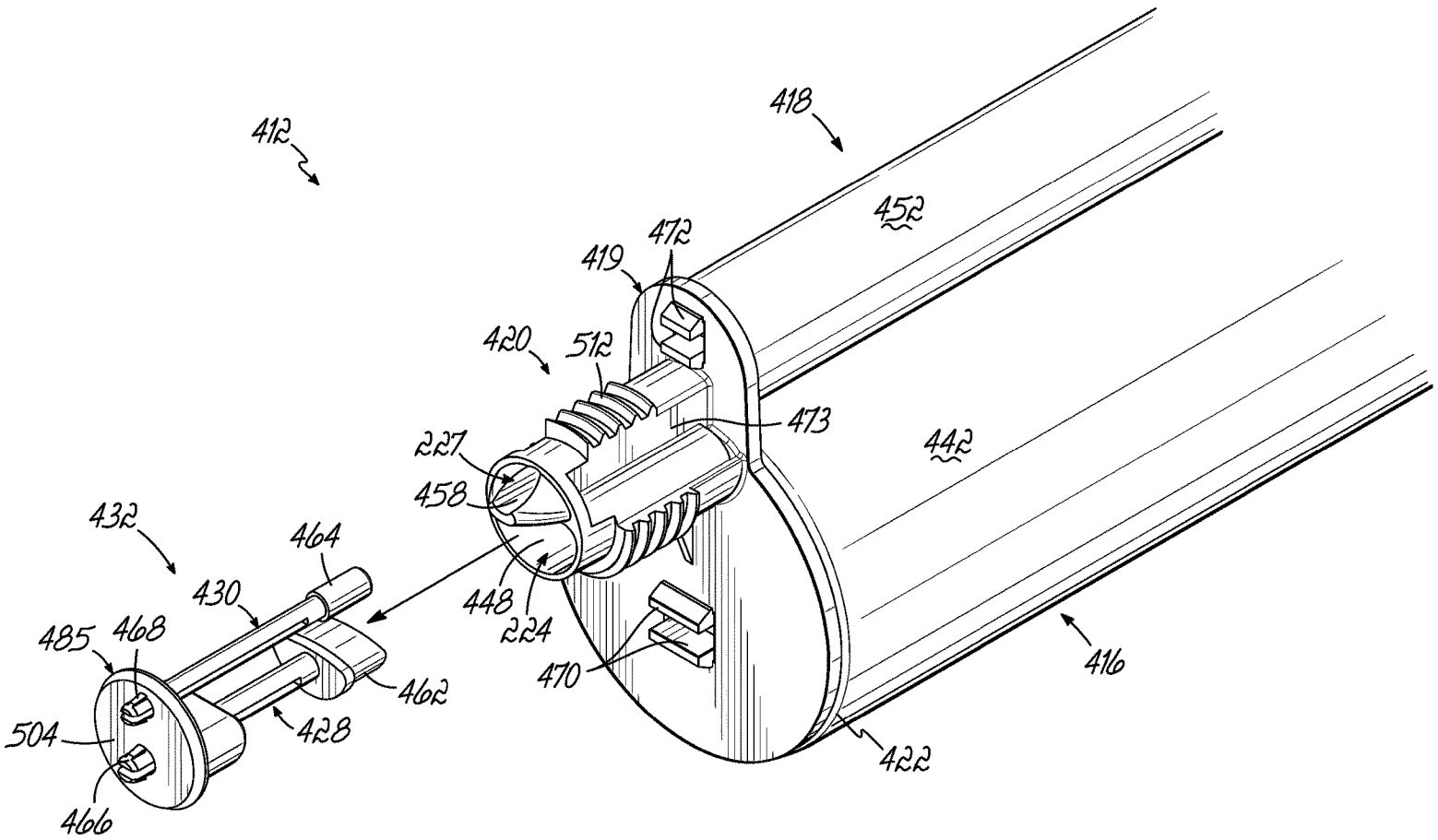
FIG. 11D is an upper perspective view similar to FIG. 11C, but showing the closure assembly removed from the pair of cartridges.

With reference to FIG. 10 and FIG. 11A, a third exemplary embodiment of a multi-component cartridge assembly 412 for being cradled by the dispensing applicator 14 (see FIG. 1) includes a resin cartridge 416 and an activator cartridge 418. The resin and activator cartridges 416, 418 in conjunction with a manifold 419 form a neck 420 projecting from a proximal end portion 422 of the multi-component cartridge assembly 412 that includes a resin outlet 424 and an activator outlet 426. The resin and activator outlets 424, 426 are more particularly resin and activator stem outlets 424, 426. In addition, a neck body 473 also includes the resin neck outlet 226 and the activator neck outlet 227. Each of the resin and activator stem outlets 424, 426 respectively receives a resin closure 428 and an activator closure 430 for fluidly sealing stem outlets 424, 426 and improving the shelf life of the fluid resin and fluid activator components prior to use. In anticipation of dispensing the fluid resin and fluid activator components, the resin cartridge 416 secures to the activator cartridge 418 in the side-by-side configuration. In addition, the resin and activator closures 428, 430 operatively connect to form a closure assembly 432 (see FIG. 11D). The operator collectively removes the closure assembly 432 (see FIG. 11D) from the resin and activator stem outlets 424, 426. With regard to the first embodiment of the multi-component cartridge assembly 12 (see FIG. 2), the second embodiment of the multi-component cartridge assembly 212 (see FIG. 6), and the third embodiment of the multi-component cartridge assembly 412, like numbers below indicate like features also described above.

Figure 12A:
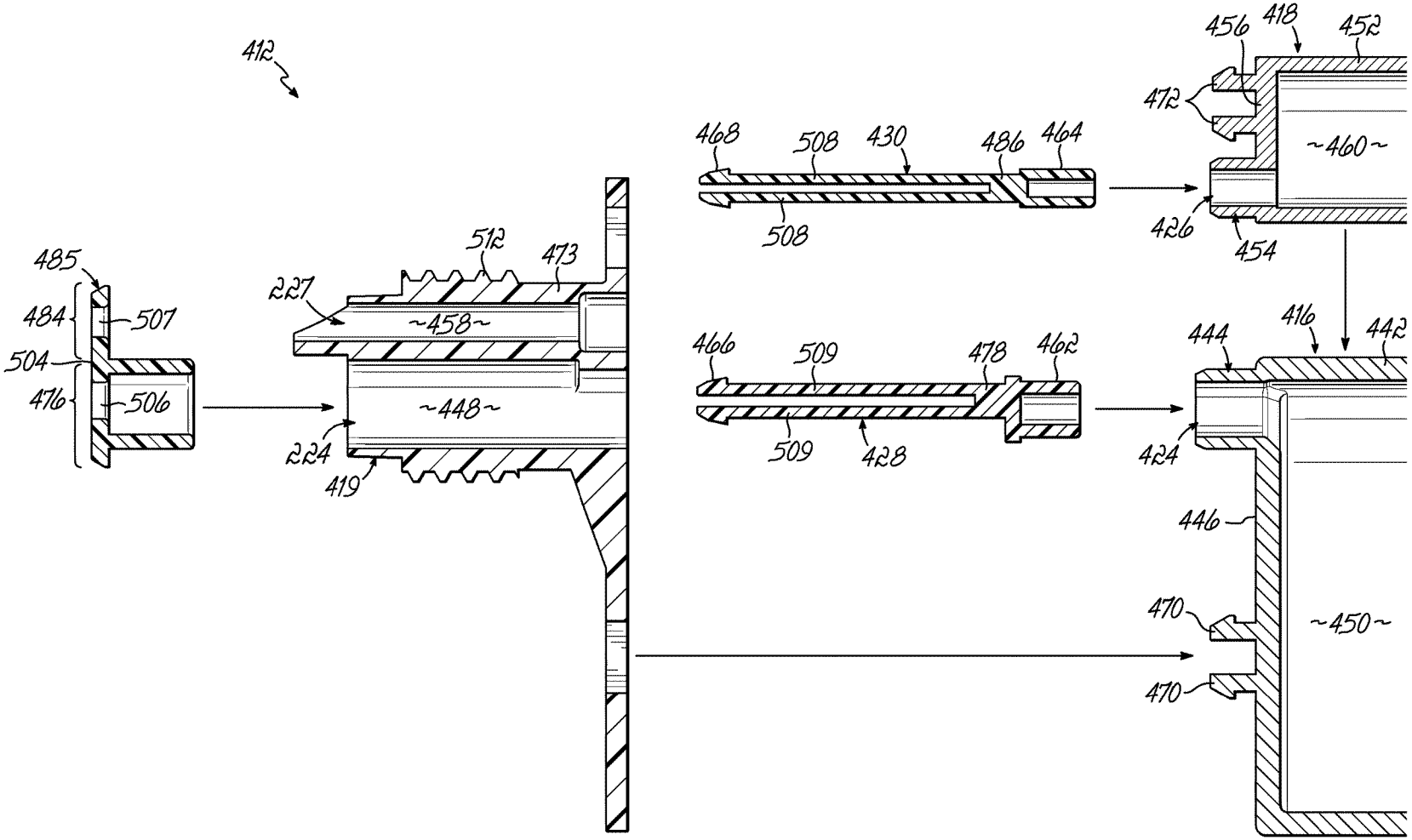
FIG. 12A is an axial cross-section view of the multi-component cartridge assembly shown in FIG. 11A.
Figure 12B:
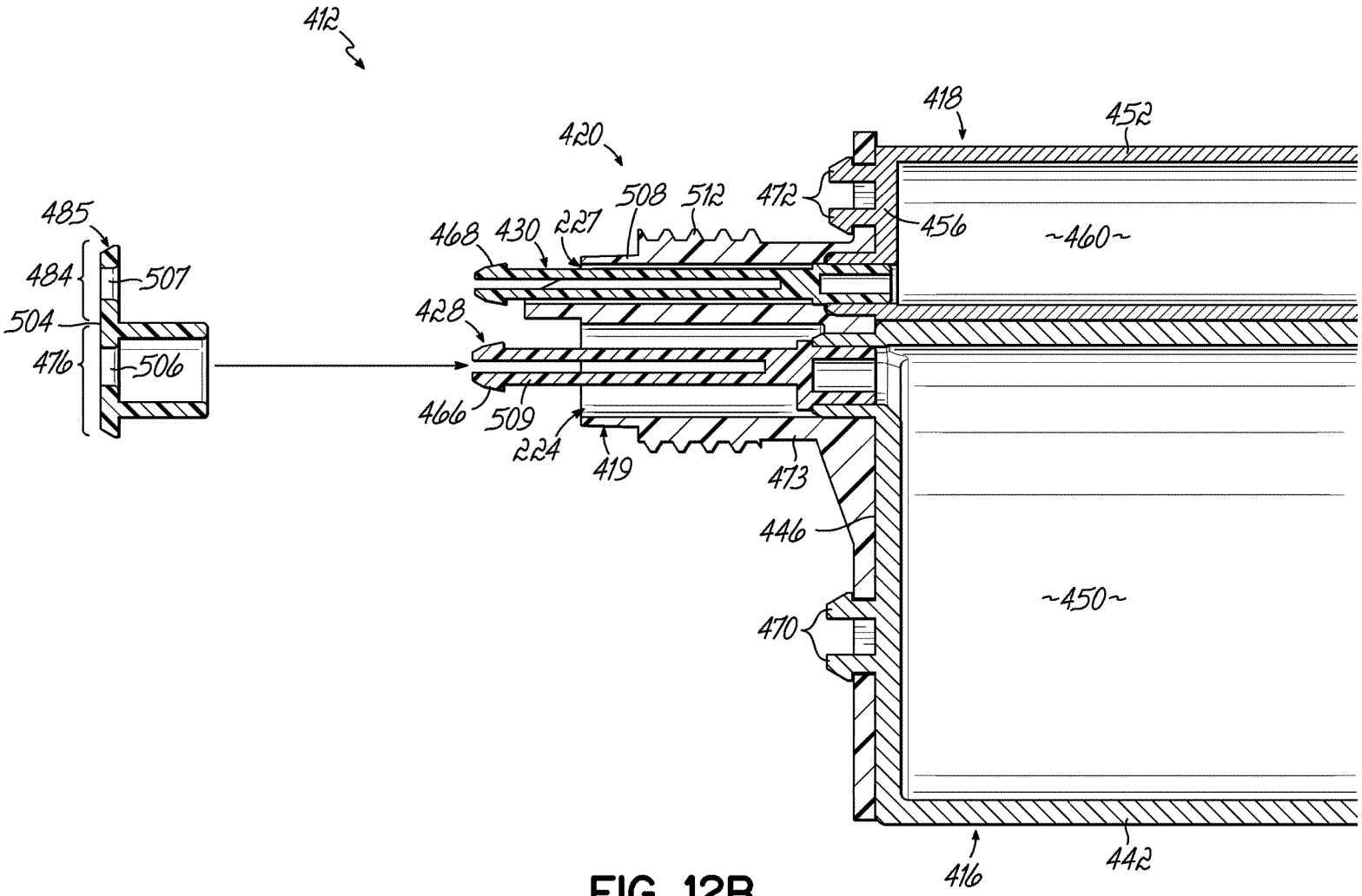
FIG. 12B is an axial cross-section view of the pair of closures and the pair of cartridges shown in FIG. 11B.
Figure 12C:
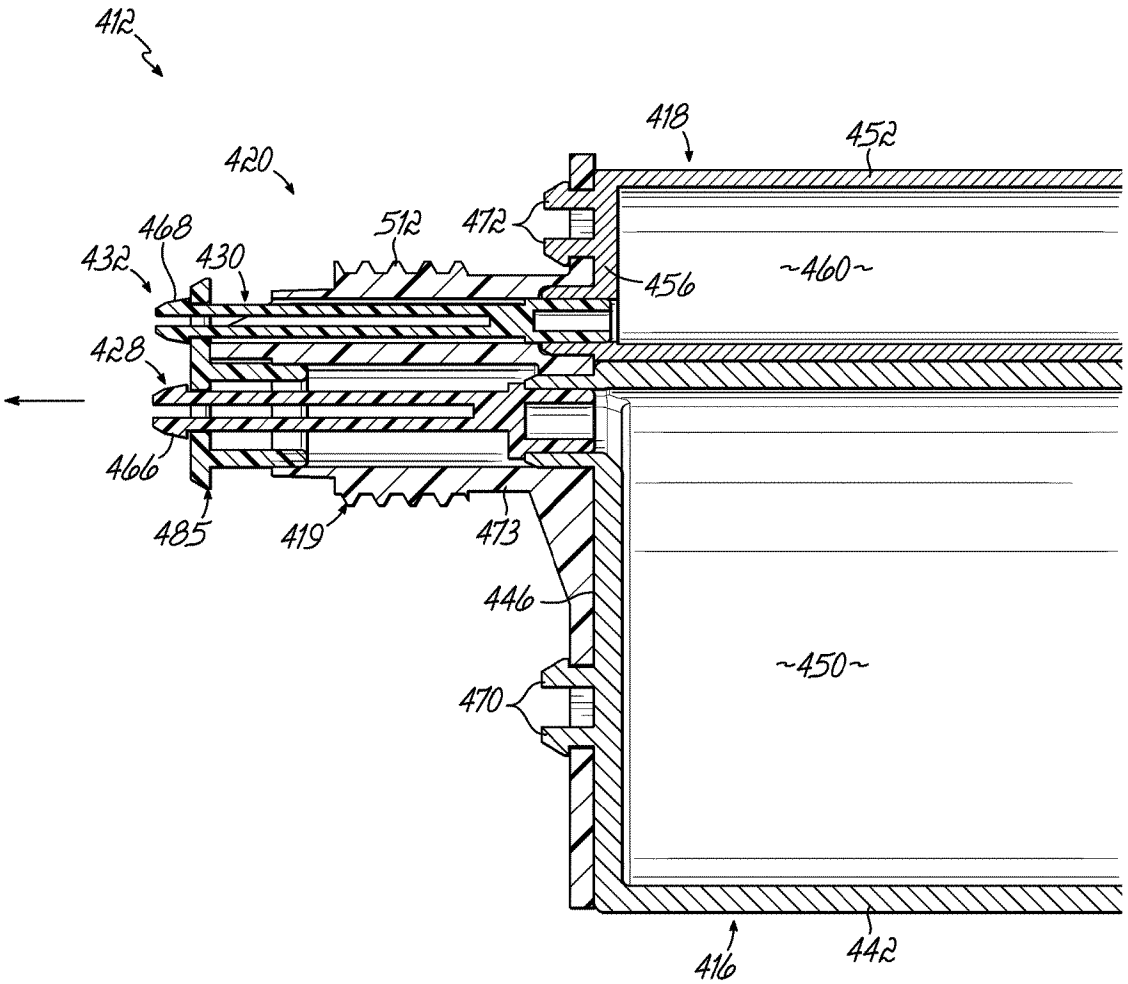
FIG. 12C is an axial cross-section of the pair of cartridges and the closure assembly of FIG. 11C.
Figure 12D:
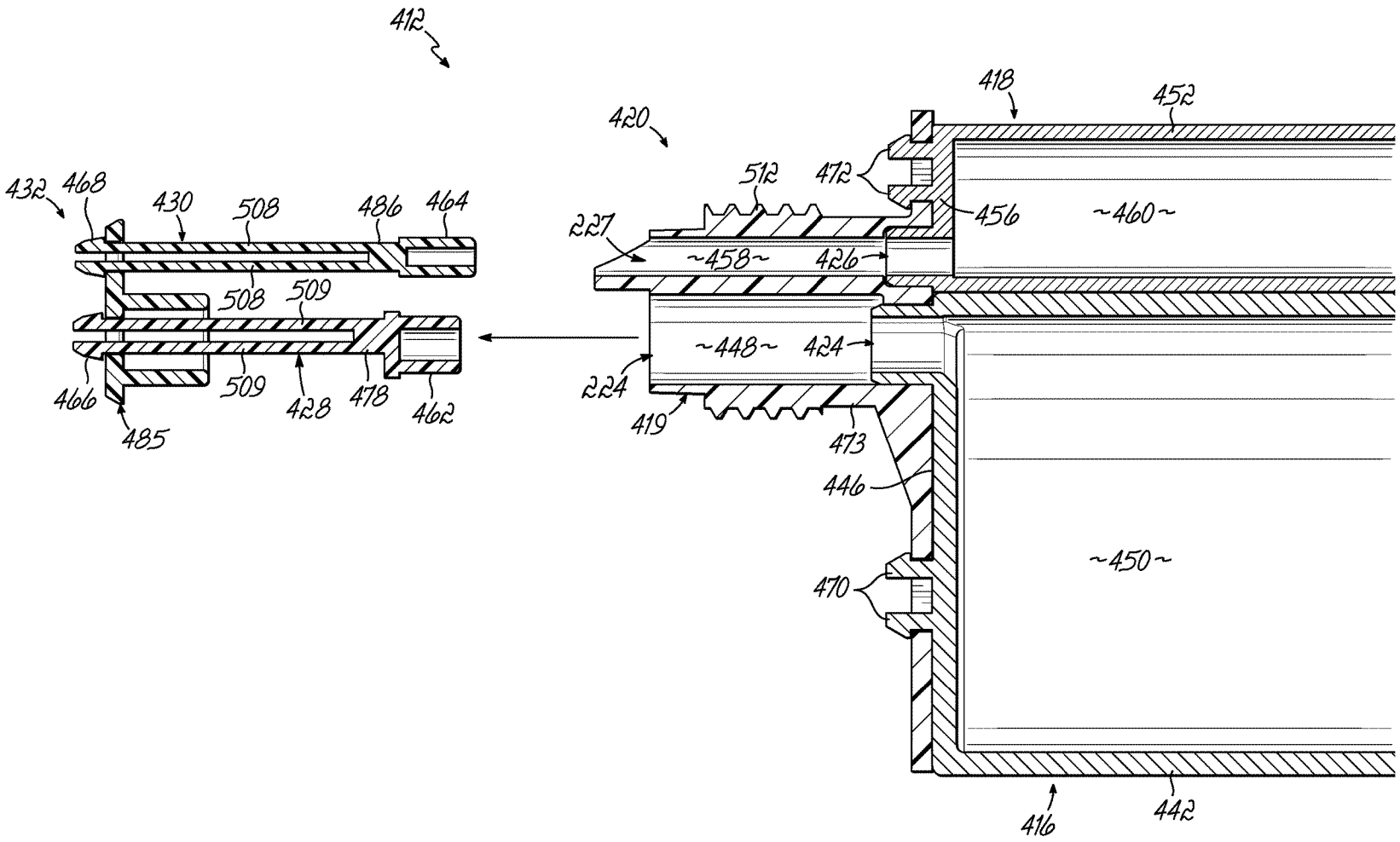
FIG. 12D is an axial cross-section of the closure assembly and the pair of cartridges shown in FIG. 11D.

The resin and activator cartridges 416, 418 of the multi-component cartridge assembly 412 are shown in FIG. 11A prior to assembly. The resin cartridge 416 includes a resin cartridge body 442 having a resin neck portion 444 extending proximally from a proximal wall 446 of the resin cartridge body 442. The resin neck portion 444 includes the resin stem outlet 424 that fluidly connects to a resin chamber 450 (see FIG. 12A). Similarly, the activator neck portion includes the activator stem outlet 426 that fluidly connect to an activator chamber 460 (see FIG. 12A). The resin stem outlet 424 partially defines a resin outlet passage 448, and the activator stem outlet 426 partially defines an activator outlet passage 458.

The resin closure 428 received within the resin stem outlet passage 448 includes a resin plug 462 projecting therefrom such that the resin plug 462 fluidly seals the resin stem outlet 424. The activator closure 430 received within the activator outlet passage 458 also includes an activator plug 464 projecting therefrom such that the activator plug 464 fluidly seals the activator stem outlet 426. The resin and activator closures 428, 430 are separate from each other within the respective resin and activator neck portions 444, 454. However, the resin and activator closures 428, 430 each include respective resin and activator closure coupling elements 466, 468 configured to cooperate and interlock with a base 485 to form the closure assembly 432 (see FIG. 11D).

The resin cartridge body 442 secures directly against the activator cartridge body 452 such that the resin cartridge body 442 and the activator cartridge body 452 extend generally parallel with each other in the side-by-side configuration. The proximal wall 446 of the activator cartridge 418 includes a pair of wall clips 470 configured to engage the manifold 419. In addition, the proximal wall 456 of the activator cartridge body 452 includes another pair of wall clips 472 configured to engage the manifold 419. The operator selectively connects the wall clips 470, 472 to the manifold 419 by moving the resin and activator cartridges 416, 418 in an axial direction toward each other. The manifold 419 includes the neck body 473 that forms the remainder of the neck 420. The neck body 473 also includes the resin and activator neck outlets 224, 227 for fluid communication with the resin and activator stem outlets 424, 426, respectively. The resin and activator closure coupling elements 466, 468 interlock with the base 485 to form the closure assembly 432 (see FIG. 11D). It will be appreciated that alternative structures for securing the activator cartridge 418 relative to the resin cartridge 416 may be used as discussed above in additional detail.

FIGS. 11A through 12D show the assembly of the resin and activator closures 428, 430 and the base 485 to form the closure assembly 432 in additional detail. The resin closure 428 includes a resin extension 478 extending distally to the resin plug 462, which includes a resin seal surface 480. The resin seal surface 480 fluidly seals against the inner surface of the resin outlet 424 and inhibits entrapment of air within the resin outlet 424 upon installation of the resin closure 428.

The activator closure 430 also includes an activator extension 486 extending distally to the activator plug 464, which includes an activator seal surface 488. The activator seal surface 488 fluidly seals against the inner surface of the activator outlet 426 and inhibits entrapment of air within the activator outlet 426.

With respect to the closure assembly 432, the resin and activator closure coupling elements 466, 468 with the base 485 for collective and simultaneous removal. Specifically, the base 485 includes a resin base section 476 integral and unitarily formed with an activator base section 484. The resin and activator base sections 476, 484 include additional closure coupling elements in the form of a wall 504 defining respective apertures 506, 507 for each base section 476, 484. The activator extension 486 includes a pair of elongate clips 508 positioned opposite the activator plug 464 and projecting proximally toward the wall 504. The resin extension 478 also includes a pair of elongate clips 509 positioned opposite the resin plug 462 and projecting proximally toward the wall 504. Each of the elongate clips 508, 509 is configured to be received respectively within the apertures 506, 507 and engage the wall 504 for interlocking the activator closure 430 operatively to the resin closure 428. Each of the resin closure 428 and the activator closure 430 respectively inserts within the resin and activator outlet passages 448, 458 to engage and interlock with the wall 504, as indicated by arrow 475.

The neck 420 includes a plurality of threads 512 that cooperate with the nut 314. The nut 314 covers at least a portion of each of the resin and activator base sections 476, 484 and holds the resin and activator closures 428, 438 within the resin and activator stem outlets 424, 426. With the closure assembly 432 removed, the neck 420 may then receive the nozzle 34 (see FIG. 1) as described above in additional detail for dispensing the fluid resin component and the fluid activator component via the dispensing applicator 14 (see FIG. 1).

In use, the operator assembles the multi-component cartridge assembly 12 for dispensing the fluid resin component and the fluid activator component from the fluid cartridge system 10 shown in FIGS. 1 through 5D. More particularly, the resin and activator outlets 24, 26 receive the resin and activator closures 28, 30 therein for fluidly sealing the resin and activator outlets 24, 26 and storing the resin and activator cartridges 16, 18 for use. Because the resin cartridge 16 and resin closure 28 are separately formed from the activator cartridge 18 and activator closure 30 so as to be independent of each other, the resin cartridge 16 may be stored apart from the activator cartridge 18 for improved shelf life and reduced component waste, such as the fluid resin and fluid activator components.

In order to prepare the fluid resin component and the fluid activator component for being dispensed from the nozzle 34 via the dispensing applicator 14, the operator operatively secures the resin cartridge 16 relative to the activator cartridge 18 as discussed briefly above, such as in the side-by-side configuration. In addition, the operator operatively connects the resin closure 28 to the activator closure 30. The resin closure 28 includes the resin closure coupling element 66 configured to interlock with one or more closure coupling elements. Similarly, the activator closure 30 includes the closure coupling element 68 configured to interlock with one or more closure coupling elements. For example, the resin closure coupling element 66 may directly interlock with the activator closure coupling element 68. Alternatively, the resin closure coupling element 66 and the activator closure coupling element 68 may interlock indirectly with one or more closure coupling elements extending between the resin and activator closure coupling elements 66, 68. In any case, the resin closure 28 and the activator closure 30 are operatively connected together to form a closure assembly 32. The operator withdraws the closure assembly 32 in a single motion in order to unseal the resin and activator outlets 24, 26. For example, the resin and activator closures 28, 30 may be simultaneously removed from the resin and activator cartridges 16, 18.

The resin and activator neck portions 44, 54 at least partially form the neck 20 such that the neck threadably receives the nozzle 34. The dispensing applicator 14 cradles the multi-component cartridge assembly 12, and the drive rod 41 engages the piston 36 within the resin cartridge body 42. The piston 36 is rigidly connected to the piston 38 within the activator cartridge body 52 such that selectively moving the piston 36 proximally via the drive rod 41 also moves the piston 38 proximally within the activator cartridge body 52. In turn, the fluid resin component and the fluid activator component discharge from the neck 20 and dispense from the nozzle 34. The nozzle 34 is configured to mix the fluid resin component and the fluid activator component. As such, the fluid cartridge system 10 dispenses a mixture of fluid resin and fluid activator component onto the substrate.

While the above description of assembling the multi-component cartridge assembly 12 and removing the closure assembly 32 is described with respect to the first embodiment of the multi-component cartridge assembly 12 shown in FIGS. 1 through 5D. It will be appreciated that the second embodiment of the multi-component cartridge assembly 210 and the third embodiment of the multi-component cartridge assembly 410 may be similarly used. Therefore, the method of use described above generally applies to each of the embodiments shown in FIGS. 1 through 12D.

More particularly, with respect to the first embodiment of the multi-component cartridge assembly 12 shown in FIGS. 2 through 5D, the operator inserts the resin closure 28 and the activator closure 30 into the resin and fluid outlets 24, 26 such that the resin and activator closures 28, 30 engage the neck 20. To this end, the operator forces the resin and activator snap members 92, 96 to resiliently bend respectively about the resin and activator neck collars 94, 98 and snap thereon. The resin and activator snap members 92, 96 respectively hold the resin and activator closures 28, 30 to the resin and activator cartridges 16, 18 to inhibit inadvertent removal of resin and activator plugs 62, 64 from the resin and activator outlets 24, 26 prior to use.

The resin closure 28 directly interlocks with the activator closure 30 by inserting the tongues 104, 110 into the grooves 106, 108, as indicated by arrow 75, to form the closure assembly 32. To remove the closure assembly 32, the operator simultaneously squeezes the resin and activator levers 100, 102 inwardly together and, in turn, pivots the resin and activator snap members 92, 96 outward and away from the neck 20. The snap members 92, 96 move away from the neck 20 far enough to disengage from the neck 20. The operator removes the closure assembly 32 from the neck 20 in order to fluidly open the resin and activator outlets 24, 26 for use as described above.

With respect to the second embodiment of the multi-component cartridge assembly 212 shown in FIGS. 6 through 9C, the operator inserts the resin closure 228 and the activator closure 230 into the resin and activator outlets 224, 226 such that the resin and activator closures 228, 230 abut against the resin neck portion 244 and the activator neck portion 254, respectively. In addition, the resin base section 276 covers the resin outlet passage 248, whereas the activator base section 284 covers the activator outlet passage 258.

The activator closure 230 directly interlocks with the resin closure 228 by inserting the activator closure 230 through a distal end of the activator outlet passage 258. The elongate clips 308 pass through the activator outlet passage 258 and are received within the aperture 306. The elongate clips 308 engage the wall 304 of the activator base section 284 to form the closure assembly 232.

The neck 220 threadably receives a nut 314 to hold the resin and activator closures 228, 230 to the neck 220 and inhibit inadvertent removal of resin and activator plugs 262, 264 from the resin and activator outlets 224, 226 prior to use. The operator removes the nut 314 prior to connection with the nozzle 34 (see FIG. 1) removes the closure assembly 232 in order to fluidly open the resin and activator outlets 224, 226 for dispensing the fluid resin and fluid activator components as described above.

With respect to the third embodiment of the multi-component cartridge assembly 410 shown in FIGS. 10 through 12D, the operator inserts the resin closure 428 and the activator closure 430 into the resin and activator outlets 424, 426 such that the resin and activator closures 428, 430 abut against the resin neck portion 444 and the activator neck portion 454, respectively. The operator positions the base 485 against the neck body 473 of the manifold 419 such that resin base section 476 and the activator base section 484 cover the resin and activator outlet passages 448, 458, respectively.

The resin closure 428 and the activator closure 430 indirectly interlock such that the base 485 directly interlocks with each of the resin closure 428 and the activator closure 430. The operator brings the manifold 419 into connection with the resin and activator cartridges 416, 418 by respectively inserting the resin closure 428 and the activator closure 430 into distal ends of the resin and activator outlet passages 448, 458. The resin and activator closures 428, 430 directly interlock with the resin and activator base sections 476, 484. The elongate clips 508 of the resin closure 428 are received within the aperture 506 of the resin base section 476, whereas the elongate clips 509 of the activator closure 430 are received within the aperture 507 of the activator base section 484. The elongate clips 508, 509 engage the wall 504 to form the closure assembly 432.

In addition, the neck 420 threadably receives the nut 314 to hold the resin and activator closures 428, 430 to the neck 420 and inhibit inadvertent removal of resin and activator plugs 462, 464 from the resin and activator outlets 424, 426 prior to use. The operator removes the nut 314 prior to connection with the nozzle 34 (see FIG. 1) and removes the closure assembly 432 in order to fluidly open the resin and activator outlets 424, 426 for dispensing the fluid resin and fluid activator components as described above.

While the present invention has been illustrated by the description of one or more embodiments thereof, and while the embodiments have been described in considerable detail, they are not intended to restrict or in any way limit the scope of the appended claims to such detail. The various features shown and described herein may be used alone or in any combination. Additional advantages and modifications will readily appear to those skilled in the art. The invention in its broader aspects is therefore not limited to the specific details, representative apparatus and method and illustrative examples shown and described. Accordingly, departures may be from such details without departing from the scope of the general inventive concept.

What is claimed is:

1. A fluid cartridge system for dispensing a first fluid and a second fluid respectively from a first cartridge and a second cartridge via a dispensing applicator, the fluid cartridge system comprising:

a first cartridge body having a first chamber for containing the first fluid;

a second cartridge body having a second chamber for containing the second fluid, wherein said first cartridge body is configured to secure against said second cartridge body in a side-by-side configuration;

a first neck portion projecting from said first cartridge body and including a first outlet communicating with said first chamber for discharging the first fluid therefrom;

a second neck portion projecting from said second cartridge body and including a second outlet communicating with said second chamber for discharging the second fluid therefrom, said first neck portion configured to operatively connect to said second neck portion to form a neck;

a first closure including a first plug projecting therefrom, said first plug received within said first outlet to fluidly seal said first outlet of said first cartridge, said first closure having a first closure coupling element; and a second closure received within said second outlet of the second cartridge, wherein the second closure is configured to operatively connect to the first closure coupling element to form a closure assembly to be removed, wherein said first cartridge body and said first closure are configured such that securing said first cartridge body to said second cartridge body simultaneously connects said first closure to said second closure, and removal of one of the first and second closures causes the other of the first and second closures to be simultaneously removed.

2. The fluid cartridge system of claim 1, wherein said first closure further comprises:

a first base section abutting against said first neck portion; and a first extension projecting from said first base section, said first extension having said first plug received within said first outlet, wherein said first base section includes said first closure coupling element configured to interlock with a second closure coupling element of the second closure.

3. The fluid cartridge system of claim 2, wherein said first closure coupling element is a tongue, and said tongue is configured to interlock with the second closure coupling element in the form of a groove.

4. The fluid cartridge system of claim 2, wherein a first snap member extends distally from said first base section, and said first snap member engages said first neck portion and removably secures said first base section to said first neck portion.

5. The fluid cartridge system of claim 4, further comprising:

a first lever projecting proximally from said first base section and connected to said first snap member, said first lever configured to pivot said first snap member and disengage said first snap member from said first neck portion.

6. The fluid cartridge system of claim 1, further comprising:

a first fluid contained within said first cartridge body, and said first fluid being a first viscous liquid.

7. The fluid cartridge system of claim 1, wherein:

the second closure includes a second plug projecting therefrom, said second plug received within said second outlet to fluidly seal said second outlet of said second cartridge, said second closure having a second closure coupling element connected with said first closure coupling element of said first closure.

8. The fluid cartridge system of claim 7, further comprising:

a first fluid contained within said first cartridge body, a second fluid contained with said second cartridge body, and said first and second fluids being a first viscous liquid and a second viscous liquid, respectively.

9. The fluid cartridge system of claim 8, further comprising:

a dispensing applicator receiving said first and second cartridges, said dispensing applicator including a nozzle connected to said neck and configured to dispense said first and second viscous liquids from said first and second cartridges.

* * * * *